US007652650B2

(12) United States Patent
Takagi et al.

(10) Patent No.: US 7,652,650 B2
(45) Date of Patent: Jan. 26, 2010

(54) CURRENT OUTPUT DRIVE CIRCUIT AND DISPLAY DEVICE

(75) Inventors: Yuichi Takagi, Kanagawa (JP); Genichiro Oga, Kanagawa (JP); Hiroshi Tachimori, Tokyo (JP)

(73) Assignee: Sony Corporation, Tokyo (JP)

( * ) Notice: Subject to any disclaimer, the term of this patent is extended or adjusted under 35 U.S.C. 154(b) by 694 days.

(21) Appl. No.: 10/525,203

(22) PCT Filed: Sep. 3, 2003

(86) PCT No.: PCT/JP03/11235

§ 371 (c)(1),
(2), (4) Date: Feb. 22, 2005

(87) PCT Pub. No.: WO2004/025614

PCT Pub. Date: Mar. 25, 2004

(65) Prior Publication Data

US 2006/0017664 A1 Jan. 26, 2006

(30) Foreign Application Priority Data

Sep. 13, 2002 (JP) ..... 2002-268036

(51) Int. Cl.
*G09G 3/36* (2006.01)

(52) U.S. Cl. ..... 345/98

(58) Field of Classification Search ..... 345/76–81, 345/87, 98–103

See application file for complete search history.

(56) References Cited

U.S. PATENT DOCUMENTS 6,222,357 B1 4/2001 Sakuragi (Continued)

FOREIGN PATENT DOCUMENTS

JP 62-122488 8/1987

(Continued)

OTHER PUBLICATIONS

Singapore Search Report mailed Mar. 3, 2006.

(Continued)

*Primary Examiner*—Amr Awad
*Assistant Examiner*—Dennis P Joseph
(74) *Attorney, Agent, or Firm*—Rader, Fishman & Grauer PLLC

(57) ABSTRACT

A circuit having a plurality of driver IC's 101-1 to 101-n provided corresponding to divided areas of a display panel 102, each driver having an output circuit for outputting a supplied reference current IREF as a drive current to corresponding divided areas DRVA1 to DRVAn of the display panel 102 and reference current source circuits 200-1 to 200-n for sampling and holding the reference current input from the reference current input terminal, then supplying the same to the output circuit, the reference current input terminal being connected to the reference current input terminal of another driver by a common current interconnect CML1, and the reference current being distributed to the reference current source circuits of drivers by time division. According to the present invention, luminance steps among drivers driving the display (driven object) by division can be made sufficiently small, and a large size, high dynamic range display organic EL display, which cannot be realized by the conventional method of supply of the reference current, can be realized.

24 Claims, 23 Drawing Sheets

U.S. PATENT DOCUMENTS

| | | | | |
|---|---|---|---|---|
| 6,246,180 | B1 * | 6/2001 | Nishigaki | 315/169.3 |
| 6,313,780 | B1 * | 11/2001 | Hughes et al. | 341/156 |
| 6,332,661 | B1 * | 12/2001 | Yamaguchi | 327/108 |
| 7,002,543 | B2 * | 2/2006 | Miyajima et al. | 345/94 |
| 7,180,496 | B2 * | 2/2007 | Koyama et al. | 345/98 |

FOREIGN PATENT DOCUMENTS

| | | |
|---|---|---|
| JP | 03-125205 | 5/1991 |
| JP | 2000-81920 | 3/2000 |
| JP | 2000-293245 | 10/2000 |
| JP | 2001-042827 | 2/2001 |
| JP | 2003-150112 | 5/2003 |
| JP | 2003-195812 | 7/2003 |
| JP | 2004-029528 | 1/2004 |

OTHER PUBLICATIONS

Singapore Written Opinion mailed Mar. 3, 2006.
International Search Report dated Dec. 12, 2003.
Japanese Office Action dated Dec. 11, 2007 for Japanese Application No. JP 2003-268036.

* cited by examiner

FIG. 13A VSYNC
FIG. 13B HSYNC
FIG. 13C START
FIG. 13D Din[m-1:0]
FIG. 13E REFSTART
FIG. 13F REFNEXT(1)
FIG. 13G REFNEXT(2)
FIG. 13H REFNEXT(n)
DIGITAL NOISE IS GENERATED
TBLK

FIG. 18A LATCH
FIG. 18B CK1
FIG. 18C CK2
FIG. 18D SEL
FIG. 18E OE0
FIG. 18F OE1
FIG. 18G IOUT (901-1)
FIG. 18H IOUT (902-1)

CURRENT OUTPUT DRIVE CIRCUIT AND DISPLAY DEVICE

TECHNICAL FIELD

The present invention relates to a current output type drive circuit employing a time division distribution system of a reference current suitable to, for example, an organic EL (electroluminescence) display device and to a display device provided with the same.

BACKGROUND ART

In recent years, organic EL display panels, which offer sharp contrasts and wide angles of vision and emit light on their own, so do not need backlights and are therefore suitable for reduction of thickness, are attracting attention.

Organic EL display panels are now entering the commercial stage in inch sizes. Advances in materials, production technology, and drive circuits have led to a succession of releases of prototype panels of the 13 to 17 inch sizes in recent years.

Organic EL elements have curved current-voltage characteristics, like diodes. The luminance-current characteristics have linear proportional relationships.

In this way, organic EL elements and thin film transistors (TFT) have threshold voltages and have large variations. For this reason, in organic EL display panels, it is proposed to use current controlled drive circuits, having proportional relationships with the luminance, to reduce uneven luminance of the display panels.

In liquid crystal panels for personal computers, televisions, and other applications, multi-bit high gradation display is required.

With just low temperature polysilicon TFT circuits formed on the panel, fabrication of multi-bit digital/analog converters (DAC) and other complex circuits is difficult, so the practice has been to bond voltage output type driver IC's, for driving vertical direction data lines, to the peripheral portions of the panel to form a module.

In the drive circuit of a large size display panel, the practice has been to use a plurality of drivers to drive the screen divided. In such a case, if the characteristics vary among drivers, there is the problem that steps of the luminance are generated at the border lines of the screen driven by division.

In the case of a liquid crystal display, the data line driver is a voltage output type. For this reason, it is possible to make the luminance step very small by the simple method of commonly connecting an interconnect line of the reference voltage between driver integrated circuits (driver IC's).

FIG. 1 is a circuit diagram of a reference voltage generation circuit used in a data line driver etc. of a liquid crystal display.

This reference voltage generation circuit generates nine reference voltages of V0, V8, . . . , and V64 by the resistance division of resistor elements R0 to R7 connected in series between a supply line of a power supply voltage $V_{DD}$ and a ground line GND. Then, by further fine interpolation among these reference voltages by DAC etc., for example, by equally dividing it by 8, voltage outputs of 64 scales can be obtained.

When providing this reference voltage generation circuit in the driver IC, even if the absolute value of the resistance varies for every driver IC, the reference voltage output is determined by the resistance ratio, so there is almost no variation among driver IC's.

FIG. 2 is a view for explaining an inter-driver IC's connection system of the reference voltage in a voltage output type data line driver.

In this case, a display panel PNL is driven by dividing it by n number of anode drivers IC's 1 to n.

Even if there is variation in the reference voltage outputs among driver IC's, as shown in FIG. 2, when the terminals of the reference voltages of all driver IC's are connected for each of the reference voltages V0, V8, . . . , and V64, the voltage averaged for each reference voltage will be supplied to all driver IC's 1 to n.

For this reason, a luminance step of a level causing a problem will not be generated at border lines of a screen driven by division.

In the case of an organic EL display, a current output type is suitable as a data line driver.

In a current output type driver IC, suitable for an organic EL display, if supplying a common reference voltage to the driver IC's and then having each driver IC perform voltage-current conversion to generate the reference current as described above, the reference current will vary among the driver IC's due to the variation of the offset voltage of the operational amplifiers and resistor elements configuring the voltage-current conversion circuits. Further, even if performing the voltage-current conversion before the final output, the output current will vary among output terminals.

In order to reduce the factors behind this current variation, an organic EL full color module drive system, employing the current connection system in a current output type anode driver IC, has been proposed (refer to for example Non-patent Document 1: "Development of Organic EL Full Color Module Drive System", Pioneer R&D, vol. 11, no. 1, page 29-36, 2001, Ochi, Sakamoto, Ishizuka, Tsuchida).

FIG. 3A is a view of this organic EL full color module drive system. In this drive system as well, a display panel OPNL is driven by division by n number of anode driver IC's 11 to 1*n*.

In the present drive system, when providing a reference current source at each of the driver IC's to set the current, the reference currents will subtly differ due to the individual differences in the performances of the IC's or the current setup parts, so sometimes luminance steps will be generated in units of IC's. Further, using a variable resistor for each IC to adjust for each IC is unsuitable for mass production; therefore, by using the closest current output of the adjacent IC as the reference current, the variation of the set currents can be absorbed and the luminance steps can be eliminated.

According to this current connection system, a step of adjusting luminance among drivers becomes unnecessary. Also, the number of interconnects of the reference current on the panel can be made relatively small.

As explained above, in the current connection system shown in FIG. 3A, luminance steps corresponding to the border lines of horizontally adjacent drivers can be eliminated.

As shown in FIG. 3B, however, a reference current IREF of the driver on the left end and a reference current IREF(n−1) on the right end become different by addition of the n number of current variations in the driver IC's.

In a large size display device, not only is the display panel driven by dividing it in the lateral direction, but also the data lines on the panel are vertically divided at the ½ positions in the vertical direction to halve the interconnect capacitances of the data lines. Together with this, the drive frequency is reduced by vertically arranging drivers and driving them in parallel and by halving the number of scanning lines which must be driven by each driver.

In such case, with the current connection system, luminance steps are sometimes generated at the vertical borders of the display panel.

As described above, with the conventional method of supply of the reference current, it is difficult to realize a large size, high gradation display type organic EL display.

For this reason, in organic EL display panels, the appearance of current output type data line drivers (source drivers) suitable for driving organic EL elements has been awaited.

DISCLOSURE OF THE INVENTION

An object of the present invention is to provide a current output type drive circuit able to make luminance steps among drivers driving a display or other driven object in division sufficiently small, able to reduce the number of interconnects of the reference current on the display panel and suited for driving organic EL elements, and a display device provided with the same.

To attain the above object, a current output type drive circuit, according to a first aspect of the present invention, provides a current output type drive circuit for outputting a drive current to a driven object shared by being divided into a plurality of areas, comprising a plurality of drivers arranged corresponding to each the shared area of the driven object, each driver comprising an output means for outputting a supplied reference current and the drive current corresponding to image data to a corresponding shared area of the driven object and a reference current source circuit for sampling and holding the reference current input from a reference current input terminal, then supplying the same to the output means.

A current output type drive circuit, according to a second aspect of the present invention, provides a current output type drive circuit for outputting a drive current to a driven object shared by being divided into a plurality of areas, comprising a plurality of drivers arranged corresponding to each the shared area of the driven object, each driver comprising an output means for outputting a supplied reference current as a drive current to the corresponding shared area of the driven object and a reference current source circuit for sampling and holding a reference current input from a reference current input terminal, then supplying the same to the output means.

Further, the reference current input terminal is connected to a reference current input terminal of another driver by a common current interconnect, and the reference current is distributed to the reference current source circuits of the drivers by time division.

A display device, according to a third aspect of the present invention, provides a display device for outputting a drive current to a shared area of a display panel shared by being divided into a plurality of areas, comprising a plurality of drivers arranged corresponding to each the shared area of the display panel, each driver comprising an output means for outputting a supplied reference current to a corresponding shared area of the driven object and a reference current source circuit for sampling and holding the reference current input from a reference current input terminal, then supplying the same to the output means.

A display device, according to a fourth aspect of the present invention, provides a display device for outputting a drive current to a shared area of a display panel, shared by being divided into a plurality of areas, comprising a plurality of drivers arranged corresponding to each shared area of the display panel, each driver comprising an output means for outputting a supplied reference current to a corresponding shared area of the driven object and a reference current source circuit for sampling and holding a reference current input from a reference current input terminal, then supplying the same to the output means, the reference current input terminal being connected to a reference current input terminal of another driver by a common current interconnect, and the reference current being distributed to the reference current source circuits of the drivers by time division.

According to the present invention, for example, the reference current input terminal of each driver is connected to a reference current input terminal of another driver by a common current interconnect.

In each driver, when receiving a signal indicating the start of distribution of the reference current, the reference current is fetched from the reference current input terminal into the reference current source circuit, and a signal indicating the start of the reference current distribution is output to the driver circuit of the next stage.

The reference current source circuit fetching the reference current samples and holds the reference current, then supplies this to the output means.

Then, the reference current supplied from the reference current source circuit is output from the output means as the drive current to the corresponding shared area of the driven object.

Further, for example, the reference current is distributed to the drivers in a vertical blanking period during which operations on the image data are suspended. After the vertical blanking period, during which digital noise is generated along with the transfer of the image data, the current held in the reference current source circuit of each driver is used as the reference current.

According to the present invention, the luminance steps among drivers driving by division can be made sufficiently small, and the number of interconnects on the display panel can be decreased.

Further, by fixing the signal of the image data during the vertical blanking period and distributing it to the data line drivers, the influence of crosstalk of the digital signal upon a reference current can be greatly reduced.

Further, when transferring the image data, by using the reference current sampled and held in a current sampling circuit provided in the reference current source circuit of each driver, the influence of noise during the operation can be made small.

As a result, there is the advantage that a large size, high gradation organic EL display can be realized.

BEST MODE FOR WORKING THE INVENTION

First Embodiment

Figure 1:
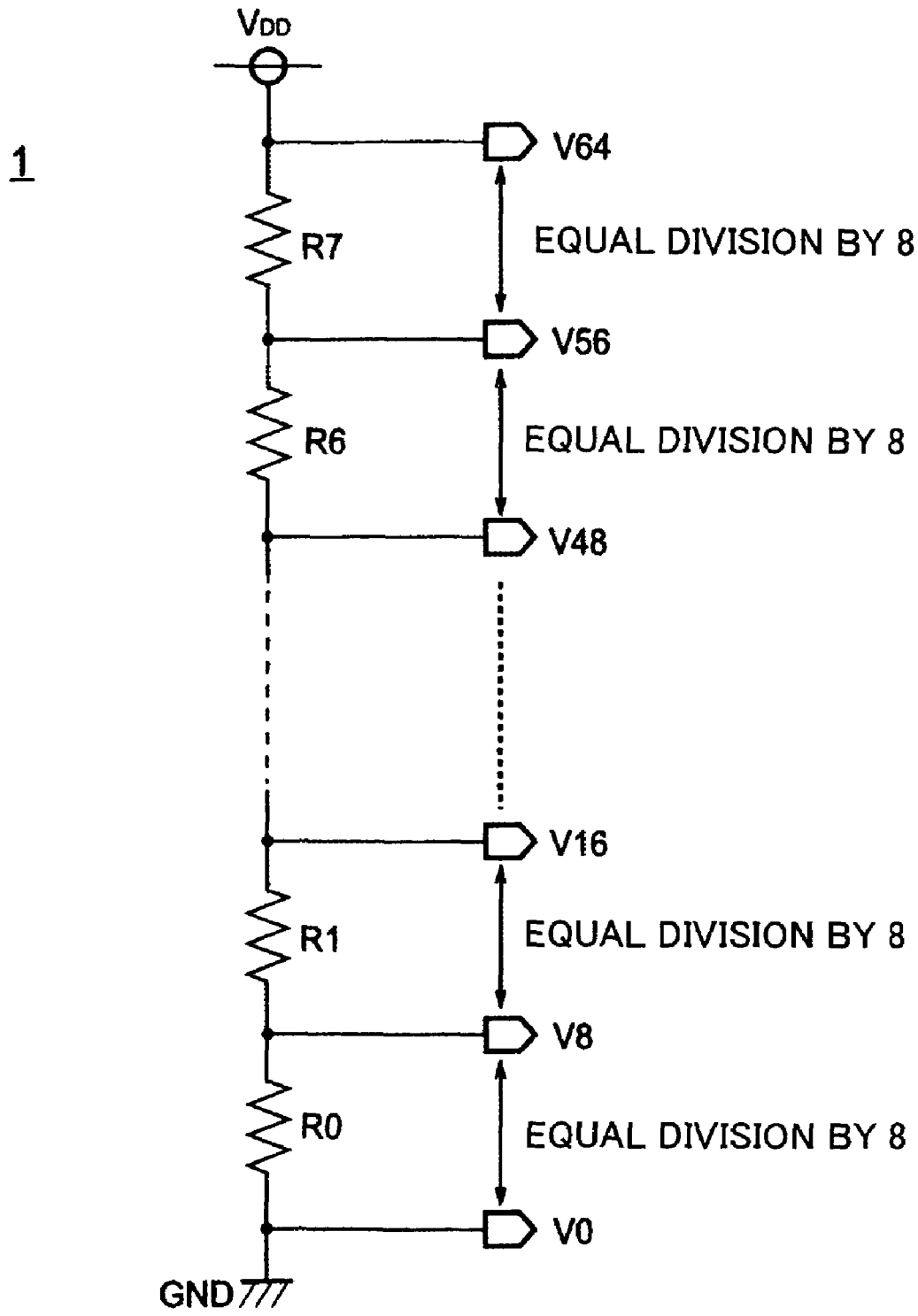
FIG. 1 is a circuit diagram of a reference voltage generation circuit used in a data line driver etc. for a liquid crystal display.
Figure 2:
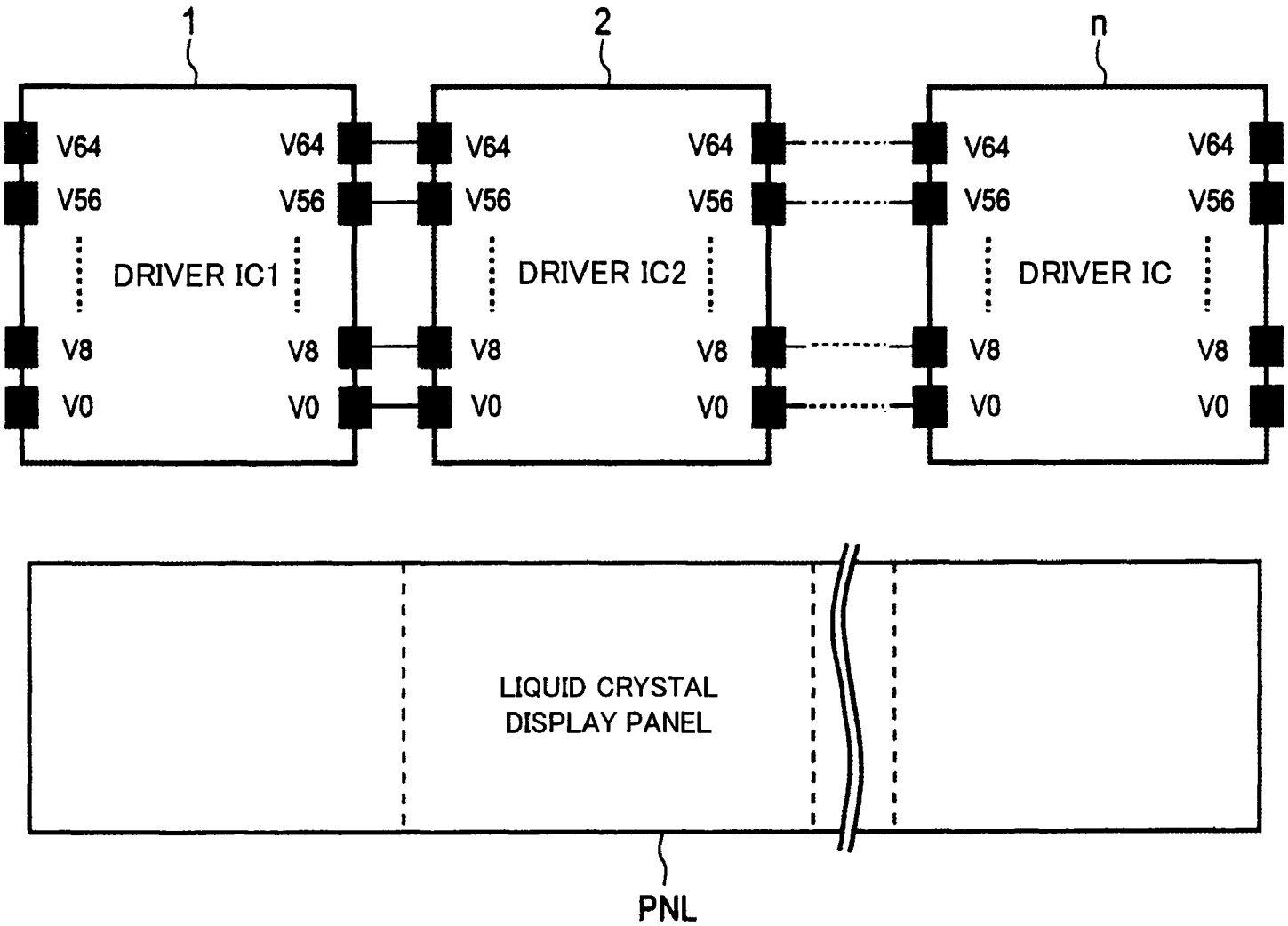
FIG. 2 is a view for explaining an inter-driver IC connection system of the reference voltage in a voltage output type data line driver.
Figure 3A:
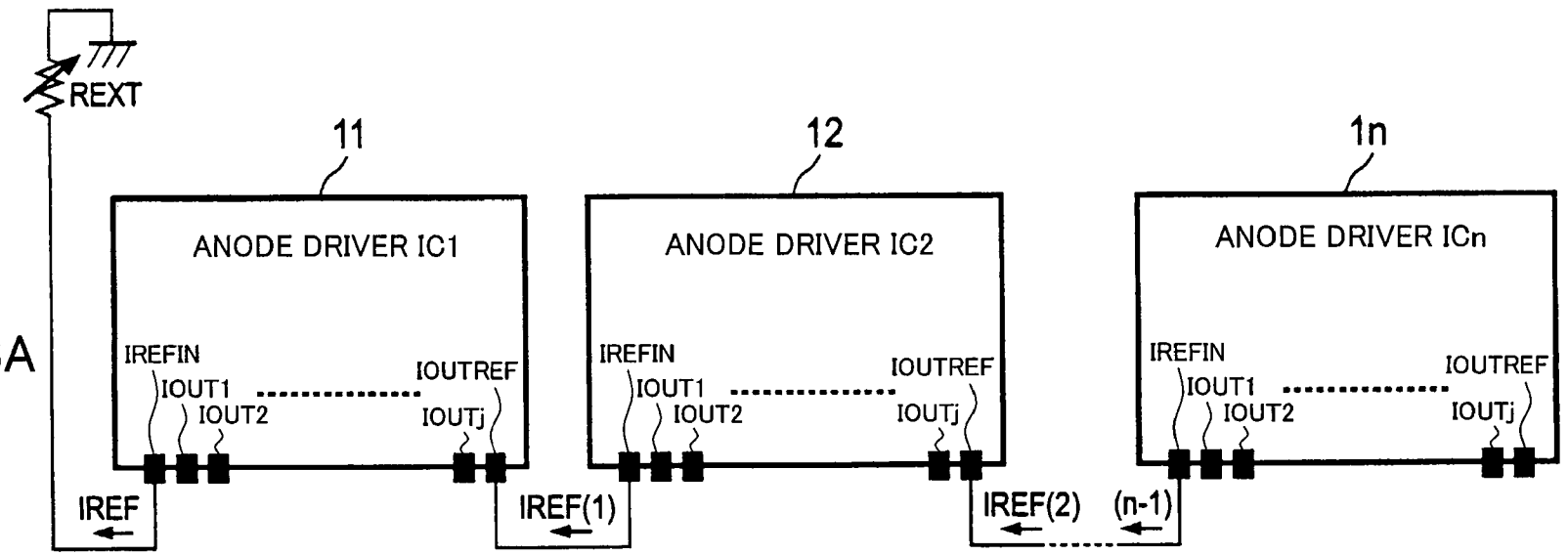
FIG. 3A and FIG. 3B are views of an organic EL full color module drive system employing a current connection method in a current output type anode driver IC.
Figure 3B:
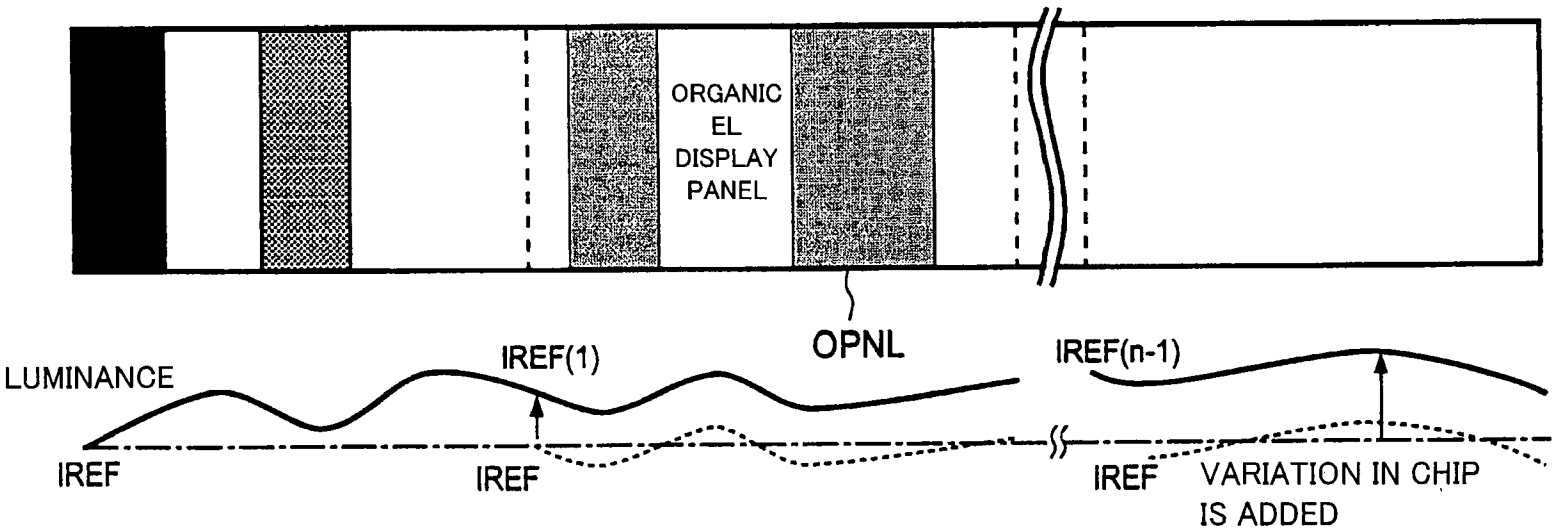
Figure 4:
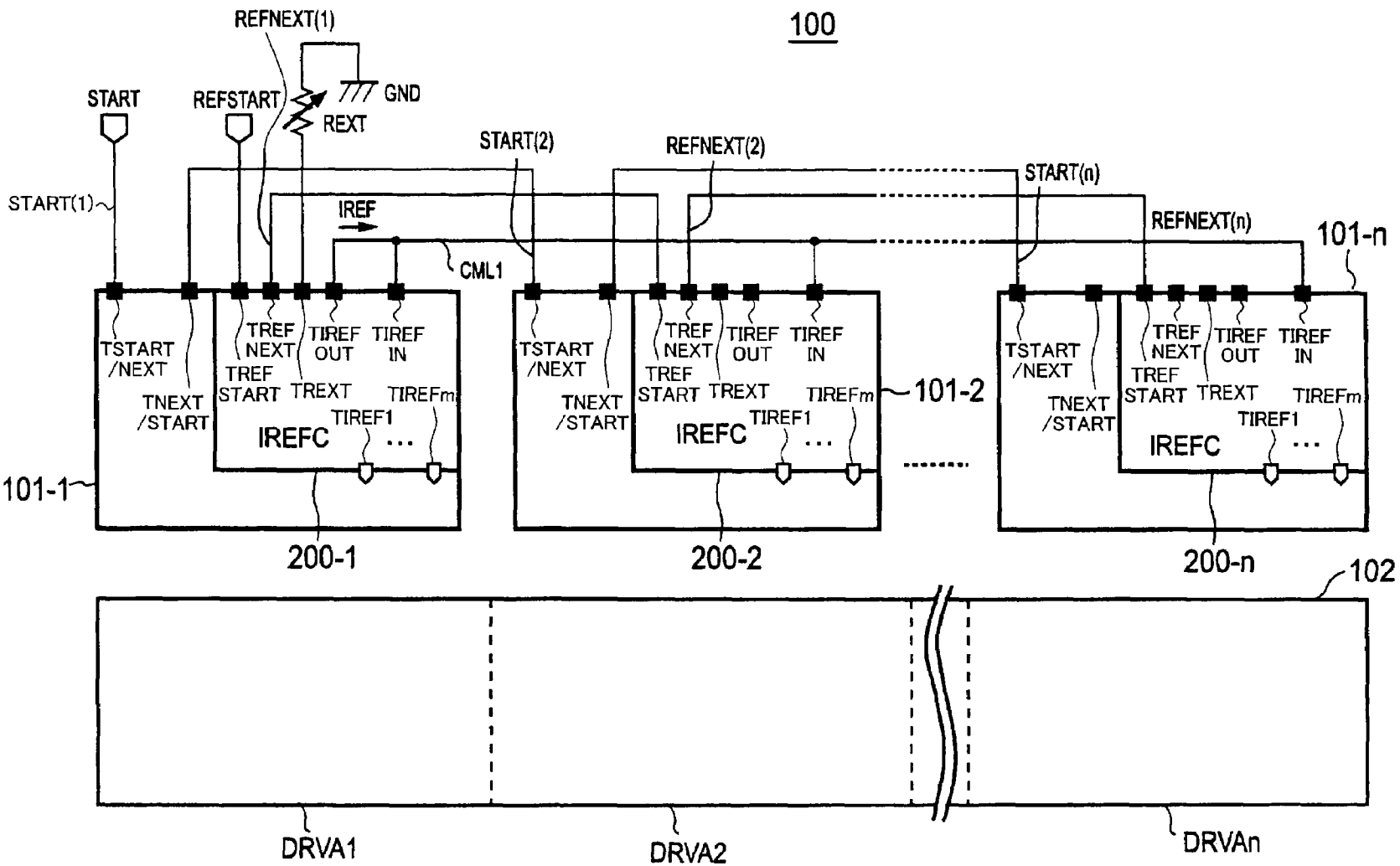
FIG. 4 is a view of the configuration of a first embodiment of an organic EL display device employing a current output type drive circuit according to the present invention.

FIG. 4 is a view of the configuration of a first embodiment of an organic EL display device employing a current output type drive circuit according to the present invention.

The present display device 100 has n number of current output type data line drivers (hereinafter simply referred to as "driver IC's") 101-1 to **101-*n* configuring the current output type drive circuit and a display panel 102 as the driven object as shown in FIG. 4**.

The present display device 100 is divided to n number of drive areas DRVA1 to DRVn. Further, n number of driver IC's 101-1 to **101-*n* are arranged in parallel on one side in a longitudinal direction in the figure (on the upper stage side in the figure) of the display panel 102 so as to correspond to the drive areas DRVA1 to DRVn. The display panel 100 is driven in division by n number of driver IC's 101-1 to 101-*n***.

This configuration corresponds to, for example, the case of the monitor of a personal computer or small sized television.

The driver IC's 101-1 to **101-*n* basically have the same configuration and, as shown in FIG. 4, include reference current source circuits (IREFC) 200-1 to 200-*n***.

The reference current source circuit 200 (-1 to -n) connects a resistor element REXT between an external resistor connection terminal TREXT of the reference current generation circuit of one driver IC serving as a master (101-1 in the present embodiment) and a ground GND and generates a reference current IREF common to the driver IC's 101-1 to **101-*n* for driving the divided drive areas DRVA1 to DRVAn of the display panel 102** to a reference current output terminal TIREFOUT in accordance with the resistance value of the resistor element REXT.

The reference current source circuits 200-1 to **200-*n* of the driver IC's 101-1 to 101-*n*** sample and hold the supplied reference current IREF and then supply the same to the inside of the drivers.

Each of the reference current source circuits 200-1 to **200-*n* has an input terminal TREFSTART, an output terminal TREFNEXT, a terminal TREXT, a reference current output terminal TIREFOUT, a reference current input terminal TIREFIN, and current distribution terminals TIREF1** to TIREFm.

In the present embodiment, the reference current IREF output from the reference current output terminal TIREFOUT of the master driver IC (101 in FIG. 4) is connected to the reference current input terminals TIREFIN of the driver IC's 101-1 to **101-*n* by a common current interconnect CML1**.

Then, in the configuration of FIG. 4, in order to make the reference current IREF of the master and currents received by the driver IC's 101-1 to **101-*n* the same, as will be explained in detail later, the driver IC 101-1, the driver IC 101-2, . . . , and the driver IC 101-*n*** employ the current distribution method so as to receive the reference current IREF in a time division manner.

Note that, in FIG. 4, the reference current IREF is generated at the driver IC101-1, but it is also possible to configure the system so as to provide another current output type DAC for the supply.

Further, the reference current is fetched in a sequence of the driver IC 101-1, the driver IC 101-2, . . . , and the driver IC **101-*n***, therefore, preferably, in order to move the flag for fetching the reference current by the input terminal TREFSTART and the output terminal TREFNEXT, these input/output terminals are connected in order.

Concretely, the input terminal TREFSTART of the reference current source circuit 200-1 of the master circuit IC 101-1 of the initial stage is connected to the input end of the signal REFSTART, and the output terminal TREFNEXT is connected to the input terminal TREFSTART of the reference current source circuit 200-2 of the driver IC 101-2 of the next stage.

The output terminal TREFNEXT of the driver IC 101-2 is connected to the input terminal TREFSTART of a driver IC 101-3 (not illustrated) of the next stage.

Below, in the same way as above, the output terminal TREFNEXT of the driver IC 101-($n$−1) is connected to the input terminal TREFSTART of the driver IC **101-*n*** of the final stage.

Note that, it is also possible not to employ such a method, but provide a control terminal indicating the sampling period, and centrally control it by a control use IC provided on the panel.

Further, the present display panel 100 also sequentially writes image data into a plurality of driver IC's in order to drive the display panel 102 in division by a plurality of driver IC's 101-1 to **101-*n***, as explained above.

For this reason, input/output terminals TSTART/NEXT and TNEXT/START, for transferring the flag indicating the write position between driver IC's, are provided.

Then, the input/output terminal TSTART/NEXT of the master driver IC 101-1 of the initial stage is connected to the input terminal of a pulse signal START indicating the start of the transfer of the image data, and the input/output terminal TNEXT/START is connected to the input/output terminal TSTART/NEXT of the driver IC 101-2 of the next stage. The input/output terminal TNEXT/START of the driver IC 101-2 is connected to the input/output terminal TSTART/NEXT of the driver IC 101-3 (not illustrated) of the next stage.

Below, in the same way as above, the input/output terminal TNEXT/START of the driver IC 101-($n$−1) is connected to the input/output terminal TSTART/NEXT of the driver IC **101-*n*** of the final stage.

In such configuration, when DIR=H (logical high level) by, for example, a write direction control signal DIR (not illustrated), the input/output terminal TSTART/NEXT functions as the START input. The TNEXT/START terminal functions as the NEXT output, the flag moves from the left to right of the driver IC in the figure, and the image data is written.

Further, when DIR=L (logical low level), the input/output terminal TSTART/NEXT functions as the START input. The input/output terminal TSTART/NEXT functions as the NEXT output, and the input/output terminal TNEXT/START of the driver IC **101-*n*** is connected to the input terminal of the pulse signal START indicating the start of transfer of the image data, the flag moves from the right to left of the driver IC in the figure, and the image data is written Namely, when a driver IC is arranged at the upper side of the display panel, the write direction control signal DIR is made equal to H, while when a driver IC is arranged at the lower side of the display panel, the write direction control signal DIR is made equal to L, whereby this can be handled by the same semiconductor chip.

Here, an explanation will be given of the sampling and transfer operation of the reference current in the display device 100 of FIG. 4 with reference to the timing charts of FIG. 5A to FIG. 5H. Note that the following explanation of the operation is merely an example. It is also possible to configure the system so that a control use IC provided on the panel centrally controls it.

In this case, the write direction control signal DIR (not illustrated) is supplied in the state of DIR=H (logical high level). The input/output terminal TSTART/NEXT functions as the START input, and the input/output terminal TNEXT/START functions as the NEXT output.

Figures 5A, 5B, 5C, 5D, 5E, 5F, 5G, 5H:
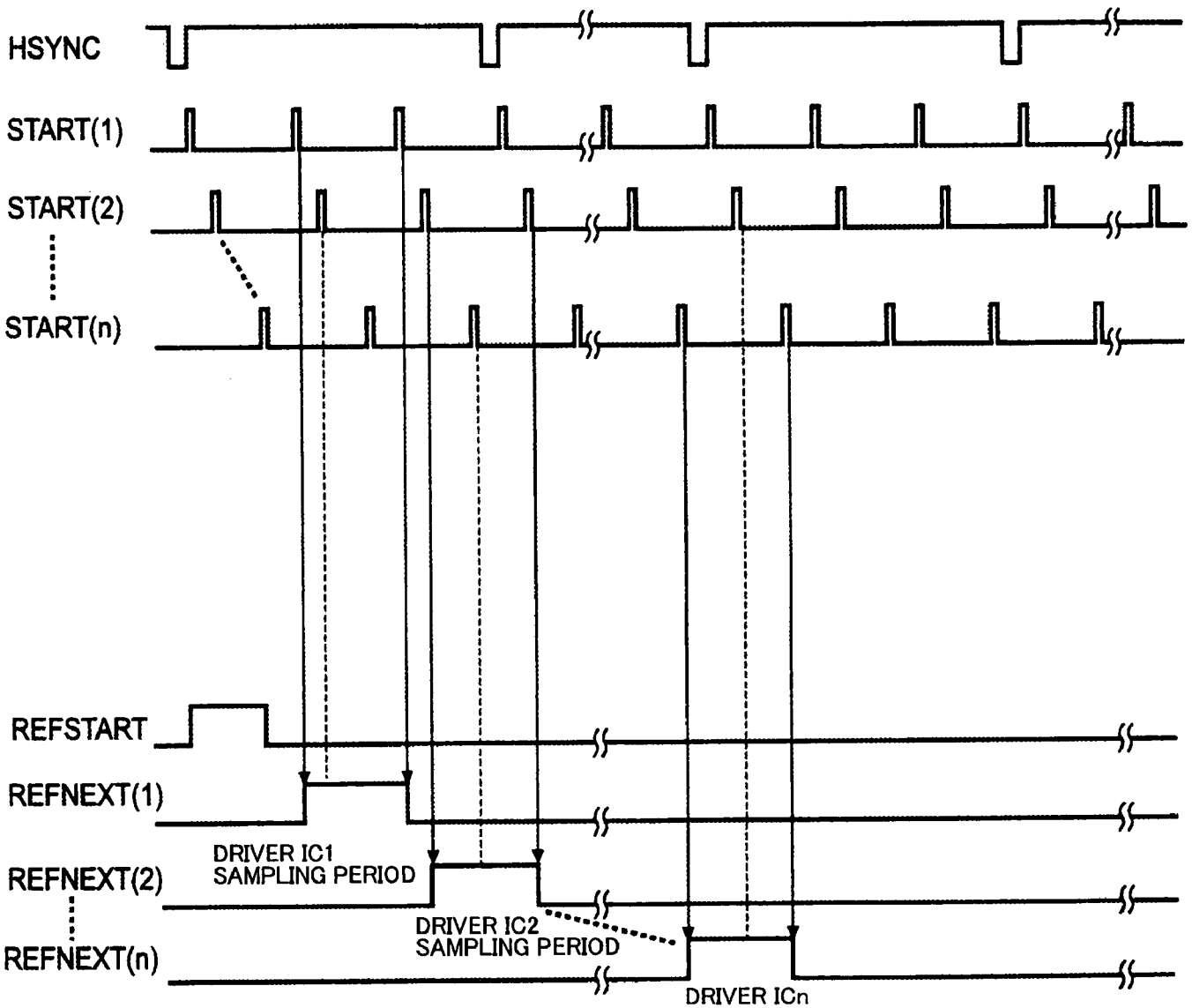
FIG. 5A to FIG. 5H are views for explaining a sampling and transfer operation of a reference current in the display device of FIG. 1.

Here, as shown in FIG. 5A, after a (downward) pulse of the horizontal synchronization signal HSYNC is input, as shown in FIG. 5B, the pulse signal START=START (1) of a first signal indicating the transfer start of the image data is input to the input/output terminal TSTART(/NEXT) of the driver IC 101-1.

When the flag moves in the driver IC 101-1 and the write operation in the memory for the image data of the driver IC 101-1 ends, a pulse signal START (2), indicating the start of writing of the driver IC 101-2, is output from the input/output terminal TNEXT(/START) of the driver IC 101-1 to the input/output terminal TSTART(/NEXT) of the driver IC 101-2. Due to this, the flag moves to the driver IC 101-2, and the image data is written into the memory for the image data of the driver IC 101-2.

In the same way as above, pulse signals START (3) to START (n) are successively output, and the image data are written into the memories for the image data of the driver IC's 101-3 to **101-*n***.

Further, as shown in FIG. 5E, a pulse signal REFSTART of the second signal, indicating the start of distribution of the reference current IREF, is input to the input terminal TREFSTART of the driver IC 101-1.

The pulse signal REFSTART is input so as to overlap the pulse START (1), as shown in FIG. 5B and FIG. 5E. The driver IC 101-1 latches the pulse signal REFSTART using the pulse signal START (1) as the drive clock and outputs the signal REFNEXT (1) pulse of 1 cycle width from the output terminal TREFNEXT at the trailing edge of the pulse signal START (1) after 1 cycle. The driver IC 101-1 fetches the reference current IREF from the reference current input terminal TIREFIN at the time of the generation of the pulse signal REFNEXT (1).

The pulse signal REFNEXT is input to the input terminal TREFSTART of the driver IC 101-2. The pulse signal REFNEXT (1) overlaps the pulse signal START (2), as shown in FIG. 5C and FIG. 5F. The driver IC 101-2 latches the pulse signal REFNEXT (1), using the pulse signal START (2) as the drive clock, and outputs the pulse signal REFNEXT (2) of 1 cycle width from the output terminal TREFNEXT at the trailing edge of the pulse signal START (2) after 1 cycle. The driver IC 101-2 fetches the reference current IREF from the reference current input terminal TIREFIN at the time of the generation of the pulse signal REFNEXT (2).

In the same way as above, pulses of REFNEXT (3) to REFNEXT (n) are sequentially output from the driver IC's 101-3 to 101-($n$−1), and the reference current IREF is sequentially fetched into the driver IC's 101-3 to **101-*n***.

Below, the concrete configuration of the driver IC 101(-1 to -n), having the above function and the function of each portion, will be explained in sequence with reference to the drawings.

Figure 6:
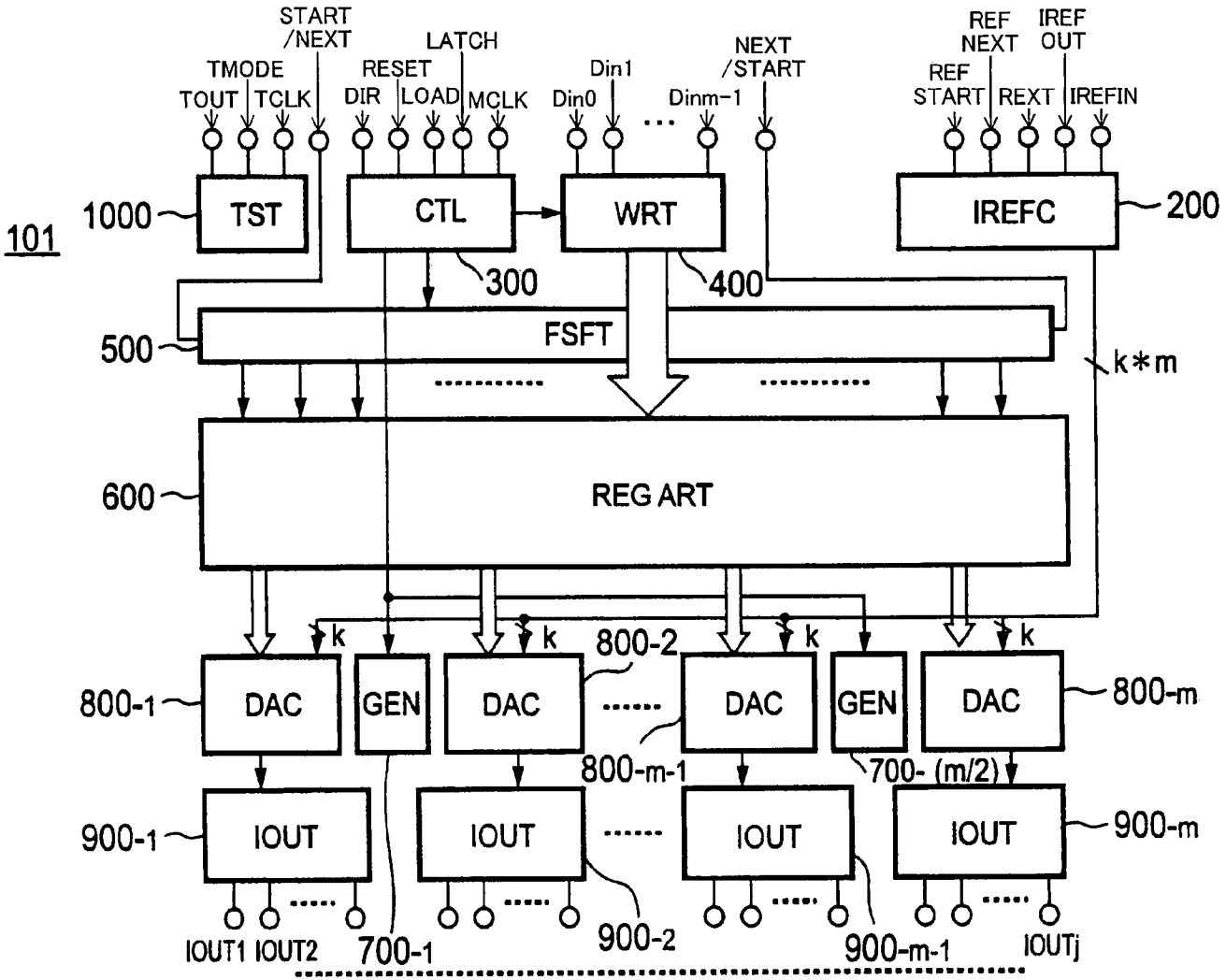
FIG. 6 is a block diagram of an example of the configuration of a current output type driver IC according to the present invention.

FIG. 6 is a block diagram of an example of the configuration of a current output type driver IC according to the present invention.

The present driver IC 101 has, as shown in FIG. 6, a reference current source circuit (IREFC) 200, a control circuit (CTL) 300, a write circuit (WRT) 400, a flag use bi-directional shift register (FSFT) 500, an image data use register array (REGARY) 600, control signal generation circuits (GEN) 700-1 and 700-($m$/2), current output type DACs (digital/analog converters) 800-1, 800-2, . . . , 800-($m$−1), and **800-*m*, current output circuits (IOUT) 900-1, 900-2, . . . , 900-($m$−1), and 900-*m*, and a test circuit (TST) 1000**.

The reference current source circuit 200 of each of the driver IC's 101-1 to **101-*n* fetches the reference current IREF into the driver IC through the reference current input terminal TIREFIN under the control of the input signal REFNEXT, copies the fetched reference current IREF for the number of DAC's or distributes the same in a time division manner, and outputs the same to the DAC's 800-1 to 800-*m***.

The reference current source circuit 200 connects the resistor element REXT between the external resistor connection terminal REXT of the reference current generation circuit of one driver IC serving as the master (101-1 in the present embodiment) and the ground GND and generates the common reference current IREF, common to the driver IC's for driving the divided drive areas DRVA1, to DRVAn of the display panel 102 to the reference current output terminal TIREFOUT in accordance with the resistance value of the resistor element REXT.

Alternatively, the system is configured so that the reference current IREF is supplied from the current source, for example, a constant current generation circuit or current output type DAC separately provided on the display panel 102, to one driver IC serving as the master (101-1 in the present embodiment).

Figure 7:
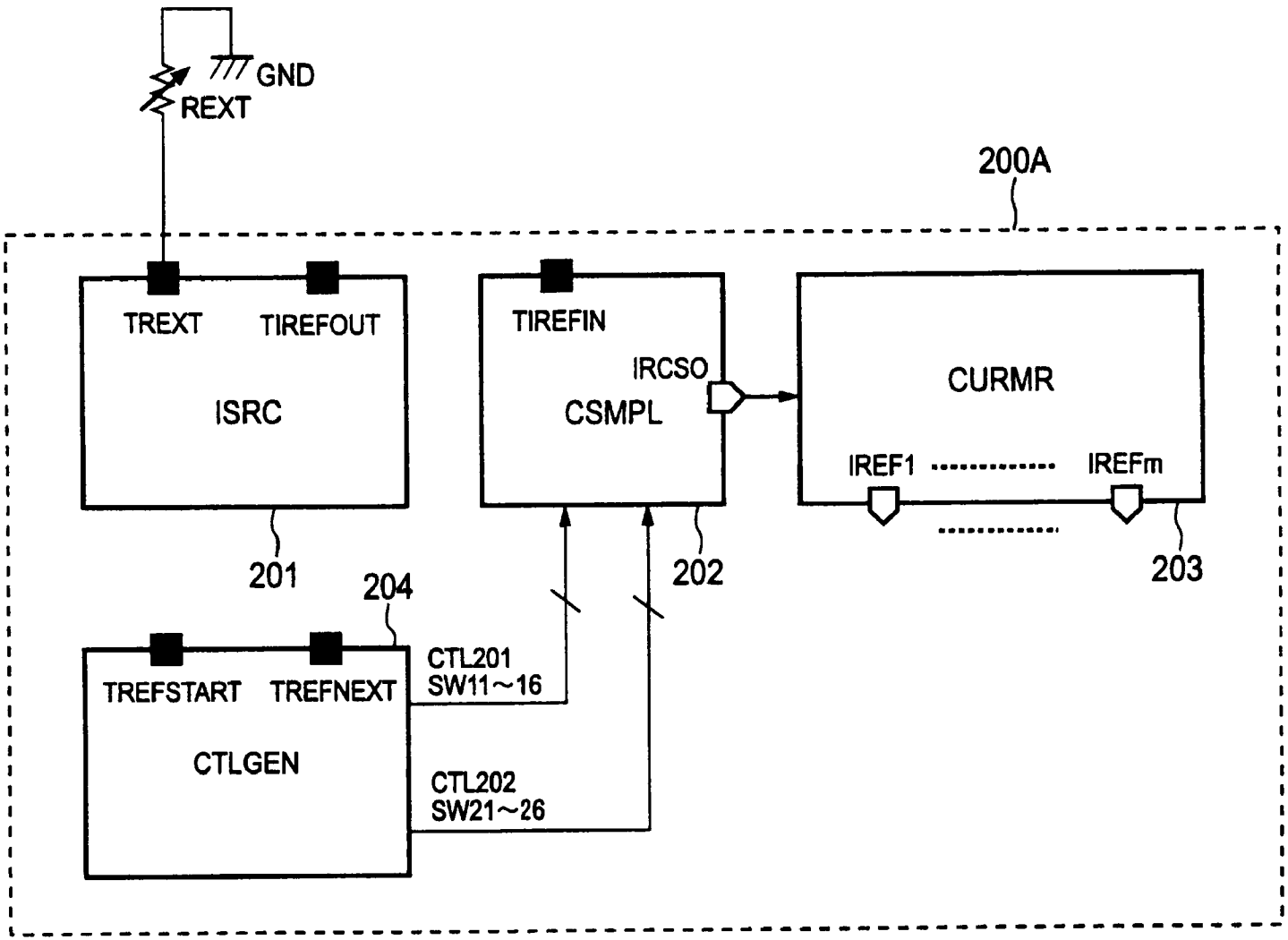
FIG. 7 is a block diagram of a first example of the configuration of a reference current source circuit according to the present embodiment.

FIG. 7 is a block diagram of a first example of the configuration of the reference current source circuit according to the present embodiment.

The present reference current source circuit 200A has, as shown in FIG. 7, a constant current source circuit (ISRC) 201 as the reference current generation circuit, a current sampling circuit (CSMPL) 202 for fetching the reference current in the time division manner, a current mirror circuit (CURMR) 203, and a control signal generation circuit (CLTGEN) 204 generating control signals CTL201 and CTL202 for controlling the operation of the current sampling circuit 202.

The constant current source circuit 201, where used as one driver IC serving as the master (101-1 in the present embodiment), connects the resistor element REXT between the external resistor connection terminal TREXT and the ground GND, generates the reference current IREF in accordance with the resistance value thereof, and outputs the same from the reference current output terminal TIREFOUT.

The reference current output terminal TIREFOUT is connected to the reference current input terminal TIREFIN of the current sampling circuit 202 of the same and other reference current source circuit by a common interconnect CML1 (not illustrated in FIG. 7).

This constant current source circuit 201 is provided inside the driver IC so as to decrease the number of parts on the display panel 102.

Figure 8:
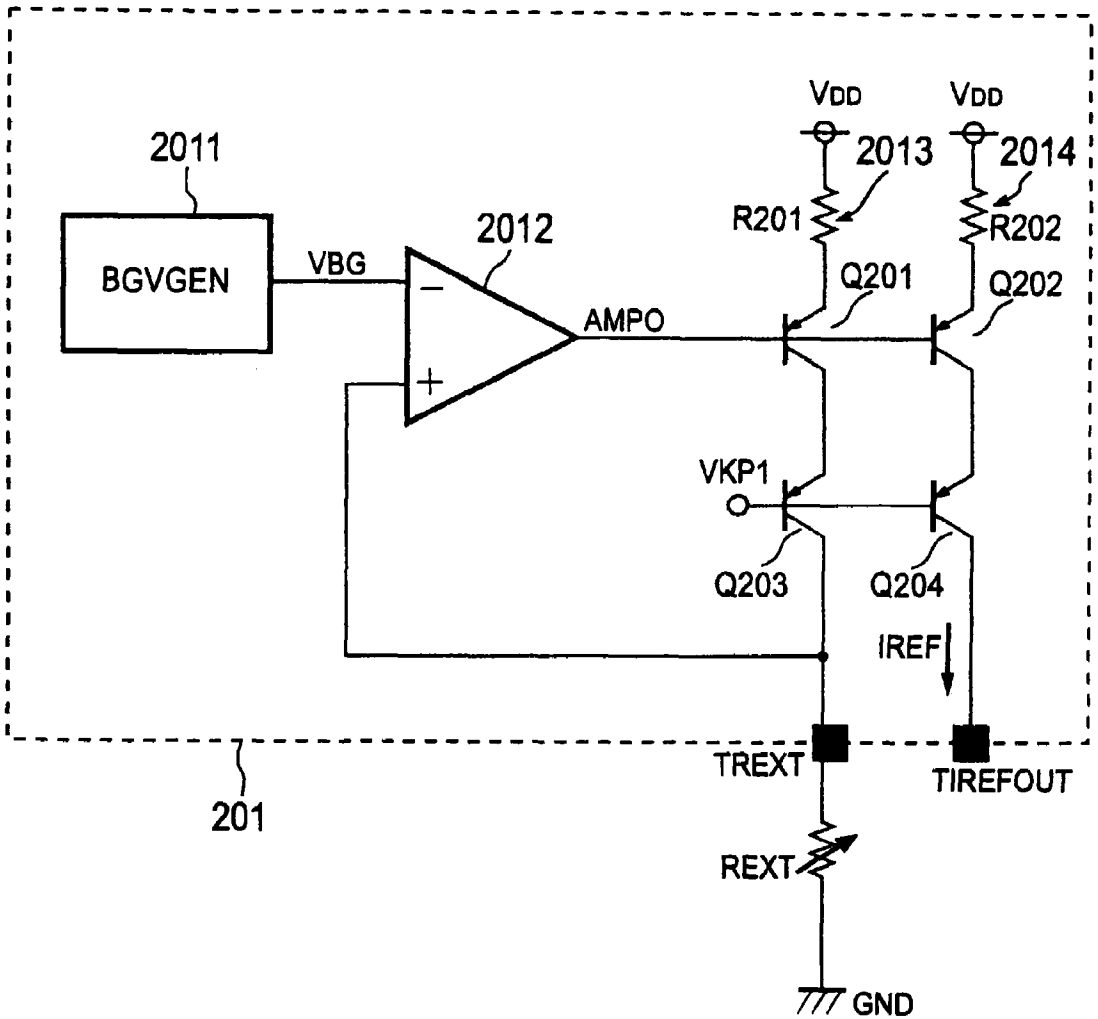
FIG. 8 is a circuit diagram of an example of the configuration of a constant current source circuit of FIG. 7.

FIG. 8 is a circuit diagram of an example of the configuration of the constant current source circuit of FIG. 7.

The constant current source circuit 201 has, as shown in FIG. 8, a band gap constant voltage generation circuit (BGVGEN), a feedback circuit 2012 using an operation amplifier, a first current source 2013 configured by a resistor element R201 and a pnp type transistor Q201, a current source 2014 configured by a resistor element R202 and a pnp type transistor Q202, pnp type transistors Q203 and Q204, and an external resistor element REXT.

One end of the resistor element R201 is connected to the supply line of the power supply voltage $V_{DD}$, and the other end is connected to the emitter of the transistor Q201. A collector of the transistor Q201 is connected to the emitter of the transistor Q203, and the collector of the transistor Q203 is connected to the terminal TREXT and a non-inverted input terminal (+) of the feedback circuit 2012.

One end of the resistor element R202 is connected to the supply line of the power supply voltage $V_{DD}$, and the other end is connected to the emitter of the transistor Q202. The collector of the transistor Q202 is connected to the emitter of the transistor Q204, and the collector of the transistor Q204 is connected to the reference current output terminal TIREFOUT.

Bases of the transistors Q201 and Q202 are connected to the output of the feedback circuit 2012, and bases of the transistors Q203 and Q204 are connected to a supply line of a base voltage VKP1 of a bias circuit (not illustrated).

Further, the inverse input terminal (−) of the feedback circuit 2012 is connected to the voltage supply line of the band gap constant voltage generation circuit 2011.

The band gap constant voltage generation circuit 2011 generates a voltage VBG obtained by making the power supply voltage dependency and temperature dependency very small.

The feedback circuit 2012 controls values of currents flowing through the first current source 2013 and the second current source 2014 by an output voltage AMPO so that the voltage of the terminal TREXT coincides with the VBG.

By this, the constant current source circuit 201 generates the reference current IREF, given by the next equation, to the collector side of the transistor Q204 and outputs it from the reference current output terminal TIREFOUT.

$$IREF \approx (VBG/KREXT) \times (KR201/KR202) \quad (1)$$

Here, KREXT indicates the resistance value of the external resistor element REXT, KR201 indicates the resistance value of the resistor element R201 of the first current source 2013, and KR202 indicates the resistance value of the resistor element R202 of the second current source 2014.

The current sampling circuit 202 has, for example, a first current memory and second current memory and writes the reference current IREF supplied from the reference current input terminal TIREFIN into the first current memory or the second current memory in response to the first control signal CTL201 and the second control signal CTL202 from the control signal generation circuit 204. Then, it outputs (reads) the reference current IREF already written in the second current memory or the first current memory from the output terminal TIRCSO to the current mirror circuit 203 in parallel to the write operation of the first current memory or the second current memory.

The current mirror circuit 203 copies reference currents IREF1 to IREFm corresponding to the number of DAC's 800-1 to 800-*m* upon receipt of the reference current IREF sampled (written) in the first or second current memory of the current sampling circuit 202 and supplies the same to the DAC's 800-1 to 800-*m*.

Figure 9:
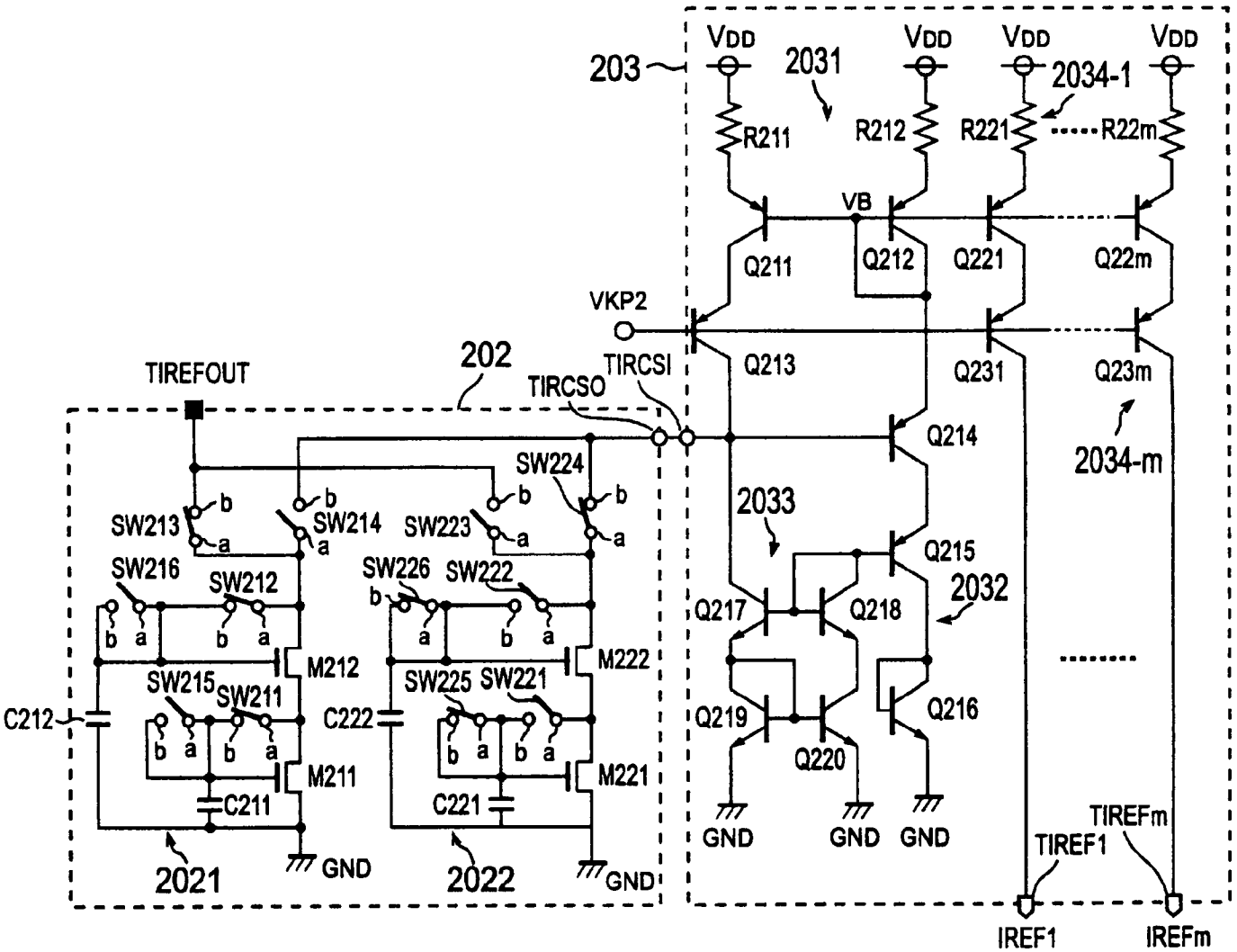
FIG. 9 is a circuit diagram of a concrete example of the configuration of a current sampling circuit and a current mirror circuit of FIG. 7.
Figures 10A, 10B, 10C, 10D, 10E, 10F, 10G, 10H, 10I, 10J, 10K, 10L, 10M:
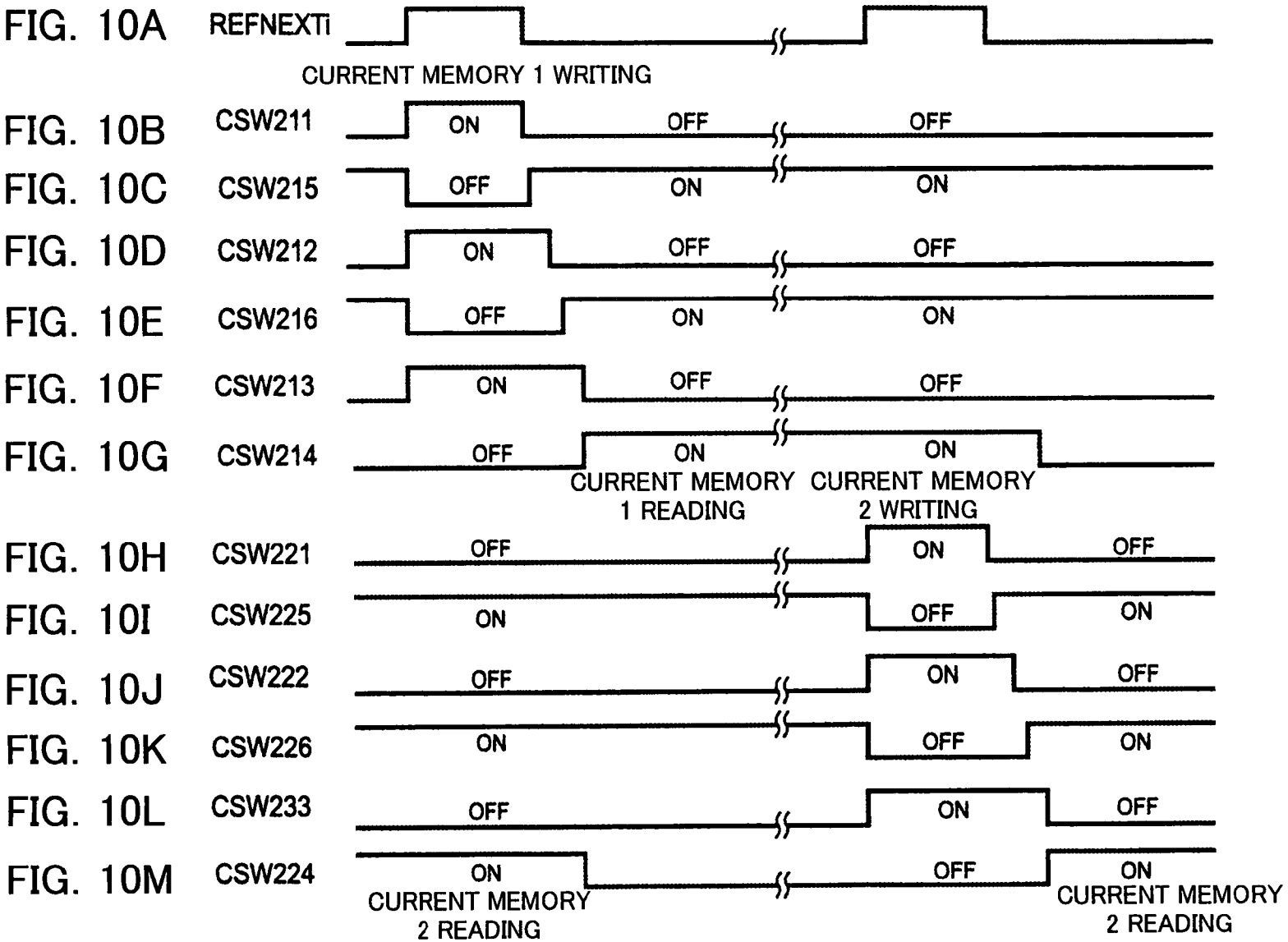
FIG. 10A to FIG. 10M are views for explaining a control operation of the current sampling circuit by a control signal generation circuit.

FIG. 9 is a circuit diagram of a concrete example of the configuration of the current sampling circuit 202 and the current mirror circuit 203 of FIG. 7.

The current sampling circuit 202 has a first current memory 2021 and a second current memory 2022 as shown in FIG. 9. These first current memory 2021 and second current memory 2022 are connected in parallel with respect to the reference current input terminal TIREFIN.

In FIG. 9, in the state where the first current memory 2021 fetches the reference current from the reference current input terminal IREFIN, it outputs the current fetched previously by the second current memory 2022 from the output terminal TIRCSO to the current mirror circuit 203.

The first current memory 2021 is an insulating gate type field effect transistor and has, for example, n channel MOS (NMOS) transistors M211 and M212, switching elements SW211 to SW216, and capacitors C211 and C212.

The source of the NMOS transistor M211 is connected to the ground GND, the first electrode of the capacitor C211 and the first electrode of the capacitor C212 are connected to the ground GND, and the drain is connected to the source of the NMOS transistor M212 and a terminal a of the switching element SW211. The gate is connected to the second electrode of the capacitor C211, a terminal b of the switching element SW211, and terminals a and b of the switching element SW215.

The drain of the NMOS transistor M212 is connected to the terminal a of the switching element SW212, the terminal a of the switching element SW213, and the terminal a of the switching element SW214. The gate is connected to the second electrode of the capacitor C212, the terminal b of the switching element SW212, and terminals a and b of the switching element SW216.

Then, the terminal b of the switching element SW213 is connected to the reference current input terminal TIREFIN, and the terminal b of the switching element SW214 is connected to the output terminal TIRCSO.

The second current memory 2022 has NMOS transistors M221 and M222, switching elements SW221 to SW226, and capacitors C221 and C222.

The source of the NMOS transistor M221 is connected to the ground GND, and the first electrode of the capacitor C221 and the first electrode of the capacitor C222 are connected to the ground GND. The drain is connected to the source of the NMOS transistor M222 and the terminal a of the switching element SW221, and the gate is connected to the second electrode of the capacitor C221, the terminal b of the switching element SW221, and the terminals a and b of the switching element SW225.

The drain of the NMOS transistor M222 is connected to the terminal a of the switching element SW222, the terminal a of the switching element SW223, and the terminal a of the switching element SW224. The gate is connected to the second electrode of the capacitor C222, the terminal b of the switching element SW222, and the terminals a and b of the switching element SW226.

Then, the terminal b of the switching element SW223 is connected to the reference current input terminal TIREFIN, and the terminal b of the switching element SW224 is connected to the output terminal TIRCSO.

By the switching (on/off) control of the switching elements SW211 to 216 and SW221 to SW226, based on control signals CTL201 and CTL202 generated by the control signal generation circuit 204, the current sampling circuit 202, having the above configuration, performs the operation of writing the reference current IREF supplied from the reference current input terminal TIERFIN into the first current memory 2021 or the second current memory 2022 and outputting (reading) the reference current IREF already written in the second current memory 2022 or the first current memory 2021 to the output terminal TIRCSO.

The concrete control will be explained later.

The current mirror circuit 203 is configured by, for example, a Wilson constant current source 2031 comprising resistor elements R211 and R212 and pnp type transistors Q211, Q212, Q213, and Q214, an output current load 2032 receiving the output current of the Wilson constant current source comprising npn type transistors Q215 and Q216, a base current sink 2033 for canceling the base current of the transistor Q214 comprising npn transistors Q217, Q218, Q219, and Q220, a current source 2034-1 comprising the resistor element R221 and the pnp type transistors Q221 and Q231 (current source 2034—comprising the resistor element R222 and the pnp type transistors Q222 and Q232), . . . , and a current source 2034-*m* comprising a resistor element R22*m* and pnp type transistors Q22*m* and 23*m*.

The input terminal TIRCSI of the reference current IREF is connected to the output terminal TIRCSO of the current sampling circuit 202. Further, the collector of the transistor Q213, the base of the transistor Q214, and the collector of the transistor Q217 are connected to the input terminal TIRCSI.

One end of the resistor element R211 is connected to the supply line of the power supply voltage $V_{DD}$, the other end is connected to the emitter of the transistor Q211, and the collector of the transistor Q211 is connected to the emitter of the transistor Q213. One end of the resistor element R212 is connected to the supply line of the power supply voltage $V_{DD}$, the other end is connected to the emitter of the transistor Q212, and the collector of the transistor Q212 is connected to the emitter of the transistor Q214 and bases of the transistors Q211 and Q212 and further bases of the transistors Q221 to Q22*m*.

The collector of the transistor Q214 is connected to the emitter of the transistor Q215, the collector of the transistor Q215 is connected to the collector and base of the transistor Q216, and the collector of the transistor Q216 is connected to the ground GND.

The base of the transistor Q215 is connected to the collector of the transistor Q218 and bases of the transistors Q217 and Q218. The emitter of the transistor Q217 is connected to the collector of the transistor Q219 and bases of the transistors Q219 and Q220. The emitter of the transistor Q218 is connected to the collector of the transistor Q220, and the emitters of the transistors Q219 and Q220 are connected to the ground GND.

Further, one end of the resistor element R221 is connected to the supply line of the power supply voltage $V___{DD}$, and the other end is connected to the emitter of the transistor Q221. The collector of the transistor Q221 is connected to the emitter of the transistor Q231, and the collector of the transistor Q231 is connected to the reference current output terminal TIERF1.

In the same way as above, one end of the resistor element R22*n* is connected to the supply line of the power supply voltage $V_{DD}$, and the other end is connected to the emitter of the transistor Q22*n*. The collector of the transistor Q22*n* is connected to the emitter of the transistor Q23*n*, and the collector of the transistor Q23*n* is connected to the reference current output terminal TIERFn.

Further, bases of the transistors Q213 and Q231 to Q23*m* are connected to the supply line of a base voltage VKP2 of a bias voltage generation circuit (not illustrated).

In the current mirror circuit 203, having such a configuration, the reference current IREF, supplied from the current sampling circuit 202, is transmitted to the current sources 2034-1 to 2034-*m* and copied. These copied reference currents IREF1 to IREFm are supplied from the reference current output terminals TIREF1 to TIREFm to the DAC's 800-1 to 800-*m*.

The control signal generation circuit 204 performs the switching (on/off) control of the switching elements SW211 to 216 of the first current memory 2021 of the current sampling circuit 202 by the control signal CTL201 and the switching elements SW221 to SW226 of the second current memory 2022 by the control signal CTL202, makes the first current memory 2021 or the second current memory 2022 write the reference current IREF supplied from the reference current input terminal TIERFIN, and makes the second current memory 2022 or the first current memory 2021 output the already written reference current IREF to the output terminal TIRCSO.

The control signal generation circuit 204 makes the first current memory 2021 or the second current memory 2022 perform the operation of writing the reference current IREF when the driver IC is generating the pulse signal REFNEXT.

Further, the control signal generation circuit 204 makes the first current memory 2021 and the second current memory 2022 alternately perform the writing whenever the pulse signal REFNEXT is input.

Namely, the control signal generation circuit 204 controls the current sampling circuit 202 so that, even if the writing is carried out into one current memory, the output current is reliably supplied from another current memory.

The control signal CTL201, generated by the control signal generation circuit 204, includes a signal CSW211 for on/off control of the switching element SW211 of the first current memory 2021 of the current sampling circuit 202, a signal CSW212 for on/off control of the switching element SW212, a signal CSW213 for on/off control of the switching element SW213, a signal CSW214 for on/off control of the switching element SW214, a signal CSW215 for on/off control of the switching element SW215, and a signal CSW216 for on/off control of the switching element SW216.

In the same way as above, the control signal CTL202, generated by the control signal generation circuit 204, includes a signal CSW221 for on/off control of the switching element SW221 of the second current memory 2022 of the current sampling circuit 202, a signal CSW222 for on/off control of the switching element SW222, a signal CSW223 for on/off control of the switching element SW223, a signal CSW224 for on/off control of the switching element SW224, a signal CSW225 for on/off control of the switching element SW225, and a signal CSW226 for on/off control of the switching element SW226.

Next, an explanation will be given of the control operation of the current sampling circuit 202 by the control signal generation circuit 204 with reference to FIG. 10A to FIG. 10M.

Note that, here, an explanation will be given of the control operation with respect to the first current memory 2021. The control operation, with respect to the second current memory 2022, is carried out in the same way; therefore, the explanation thereof is omitted here.

At the time of the current writing, as shown in FIG. 10B to FIG. 10G, the control signals CSW214 and CSW211 to CSW213 are supplied by the control signal generation circuit 204 to the current sampling circuit 202 so that the switching elements SW211, SW212, and SW213 become ON in the state where the switching element SW214 is OFF.

Along with this, the switching elements SW211 and SW212, and SW213 become ON, and the NMOS transistors M211 and M212 enter the diode-connected state. By this, the input current flows through each MOS transistor, and each drain voltage is input to the electrode of the capacitor C211 and the electrode of the capacitor C212. At this time, the drain voltage=the gate voltage, so a gate voltage, such that the input current becomes just the saturation current, is input.

When the operation mode shifts from current writing to current reading, the control signals CSW214 and CSW211 to CSW213 are supplied to the current sampling circuit 202 by the control signal generation circuit 204 so that the switching elements SW211, SW212, and SW213 become OFF in that sequence in the state where the switching element SW214 is OFF.

Along with this, the gate voltage of the NMOS transistor M211 and the gate voltage of the NMOS transistor M212 are sequentially held in the electrode of the capacitor C211 and the electrode of the capacitor C212.

Finally, the control signal CSW214 is supplied to the current sampling circuit 202 by the control signal generation circuit 204 so that the switching element SW214 becomes ON.

Further, the control signals CSW215 and CSW216 are supplied to the current sampling circuit 202 by the control signal generation circuit 204 so that the switching elements SW215 and SW216 conversely become ON when the switching elements SW211 and SW212 become OFF.

By turning on the switching elements SW215 and SW216 and turning off the switching elements SW211 and SW212, charges generated by the switching operation of the switching elements SW211 and SW212 are cancelled.

At the time of the current reading, the control signals CSW214 and CSW211 to CSW213 are supplied to the current sampling circuit 202 by the control signal generation circuit 204 so that the switching elements SW211, SW212, and SW213 turn off and the switching element SW214 turns on.

Along with this, in the state where the switching elements SW211, SW211, and SW213 are OFF, and the switching element SW214 is ON, the saturation current of the NMOS transistor M211, determined by the gate voltage held in the capacitor C211, is output to the output terminal TIRCSO. At the time of the current reading, the NMOS transistor M212 functions as a cascode transistor.

By the provision of the MOS transistor, having the cascode configuration and the provision of the switching element for canceling the charges generated by the switching operation, the current values at the time of the current writing and at the time of the current reading coincide with sufficient precision. For this reason, it becomes possible to distribute the reference current of the master to the drivers with a very high precision.

By adding the MOS transistor, having the cascode configuration, the current precision at the time of the current writing and at the time of the current reading could be enhanced, but there is the disadvantage that the value of an effective voltage Veff=VGS−Vth, determining the current value IREF among voltages VGS held in the capacitors, becomes small by employing the cascode configuration.

The voltage Vmax, necessary for the operation of the current sampling circuit, is given by following Equation 2 to Equation 6. First, here, when VGS1=Veff1+Vth and VGS2=Veff2+Vth, the following equation stands for the first MOS transistor M211.

$$\begin{aligned} I\max &= (1/2)\beta(W1/L)*(VGS1-Vth)2 \\ &= (1/2)\beta(W1/L)*Veff12 \end{aligned} \tag{2}$$

In the same way as above, the following equation is obtained for the second MOS transistor M212.

$$\begin{aligned} I\max &= (1/2)\beta(W2/L)*(VGS2-Vth)2 \\ &= (1/2)\beta(W2/L)*Veff22 \end{aligned} \tag{3}$$

In Equation 2 and Equation 3, W1 and W2 indicate channel widths of the transistors M211 and M212, and L indicates the channel length of the transistors M211 and M212. Imax is the maximum value of the output current of the current output type drive circuit.

Veff1 and Veff2 in Equation 2 and Equation 3 may be effective voltages necessary for passing the current through the MOS transistors M211 and M212. When an effective voltage is small, it becomes easily affected by the coupling capacitance between the drain and the gate and the on/off operation of the switching elements SW211 and SW212.

The maximum voltage Vmax supplied to the MOS transistors M211 and M212 employing the cascode configuration is given by the following equation:

$$\begin{aligned} V\max &= VGS1 + VGS2 + \alpha \\ &= Veff1 + Veff2 + 2Vth + \alpha \end{aligned} \tag{4}$$

In Equation 4, the constant α is the voltage between the drain and the source of the MOS transistors configuring the switching elements SW213 and SW214, and α=about VDS≈0.2V. When considering the connection with the DAC output, the maximum voltage Vmax is given by the following equation:

$$V\max \leqq (1/2)VDD \quad (5)$$

Here, when Vth=0.75V and VDD=4.75V, the following result is obtained:

$$V\text{eff}1+V\text{eff}2=0.675\text{V} \quad (6)$$

According to Equation 6, it is seen that Veff1 and Veff2 take considerably small voltages such as several hundred mV. The error of several mV generated at the time of the sampling and holding becomes the problem. Therefore, sufficient care is required so that the crosstalk of the digital signal will not ride on the reference current interconnect for distributing the reference current between driver IC's.

Next, an explanation will be given of the layout of the resistor elements configuring the current mirror circuit 203, the distribution operation of the reference current between driver IC's, and the shield and stabilization method of the reference current interconnect for distributing the reference current between driver IC's with reference to the drawings.

Figure 11C:
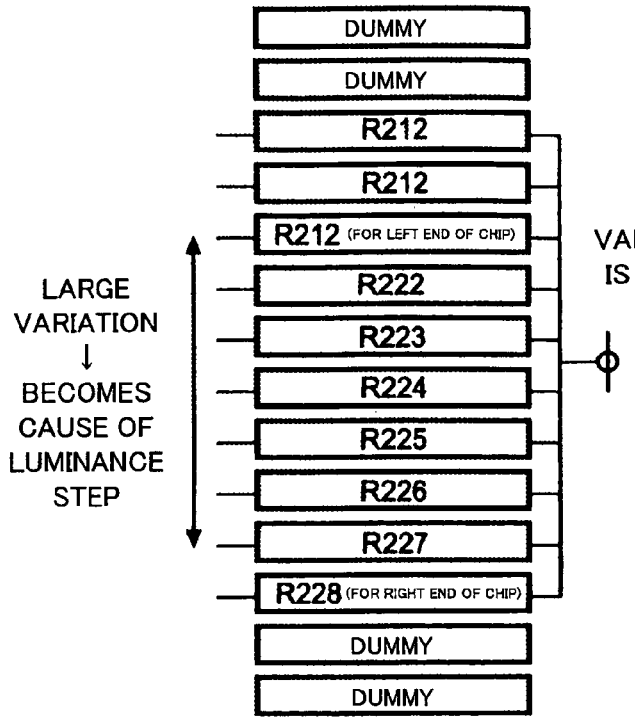
FIG. 11A to FIG. 11C are views showing an example of the layout of resistor elements configuring the current mirror circuit.
Figure 11A:
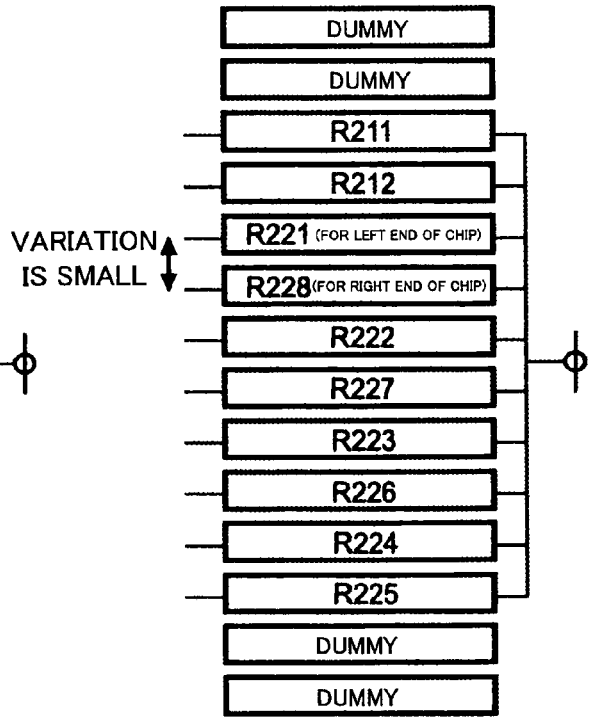
Figure 11B:
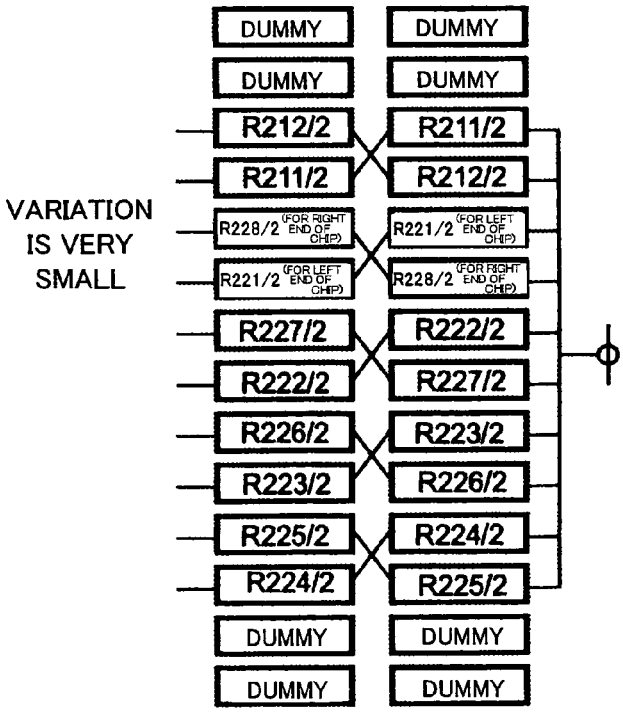

FIG. 11A to FIG. 11C are views showing an example of the layout of the resistor elements configuring the current mirror circuit 203.

Here, an explanation will be given of a case where the number of DAC's provided in the driver IC is set as m=8. As explained above, the resistor elements R211 and R212 are resistor elements configuring the Wilson constant current source 2031. Further, resistors R221, R222, . . . , and R228 are resistor elements configuring a current source 2034-1, a current source 2034-2, . . . , and a current source 2034-8.

Further, the current mirror circuit 203 supplies the reference currents IREF1, IREF2, . . . , and IREF8 to the DAC 800-1, DAC 800-2, . . . , and DAC 800-8 arranged in the driver IC from the left to right in the figure.

FIG. 11A shows an example of a preferred layout.

In the example of FIG. 11A, the layout is made so that the resistor element R221 of the reference current source 2034-1 of the DAC 800-1 at the left end of the driver IC chip and the resistor element R228 of the reference current source 2034-8 of the DAC 800-8 at the right end of the chip become close to the resistor elements R211 and R212 of the Wilson constant current source 2031.

Further, the resistor elements of the reference current source supplying to the DAC's are assigned to alternate DACs from the left to right and assigned so that the reference current is returned alternately from right to left.

Figure 12:
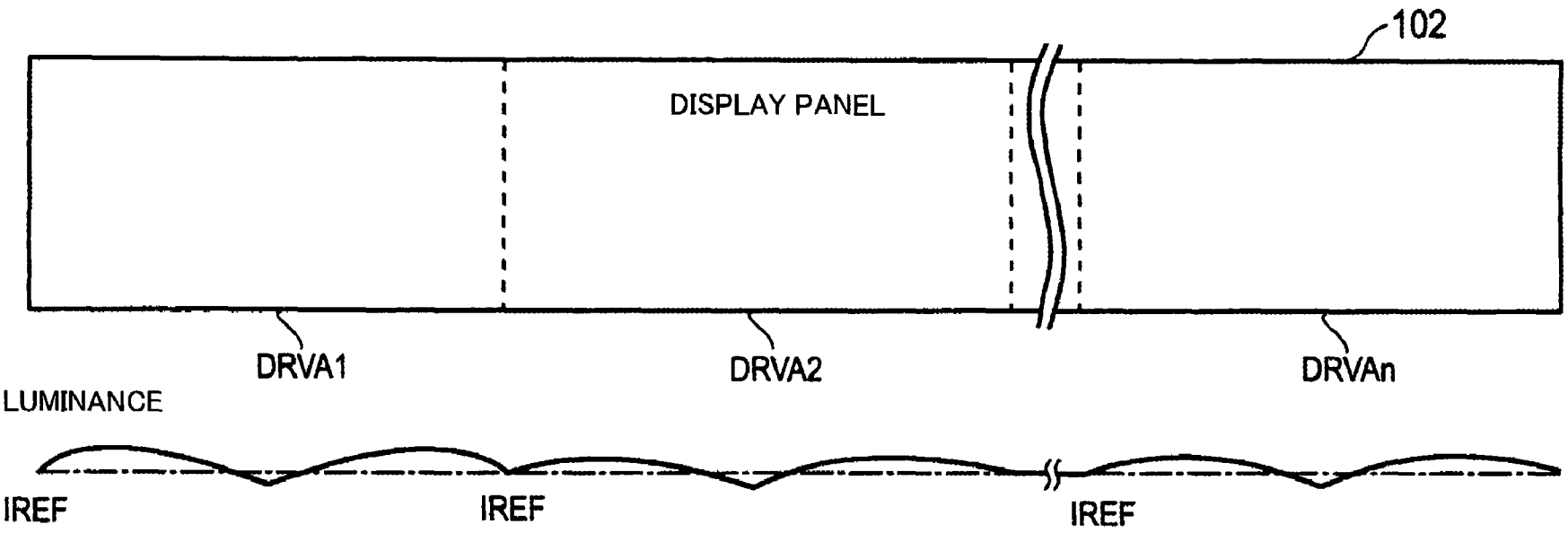
FIG. 12 is a view for explaining the effect of the layout of FIG. 11A to FIG. 11C.
Figure 13:
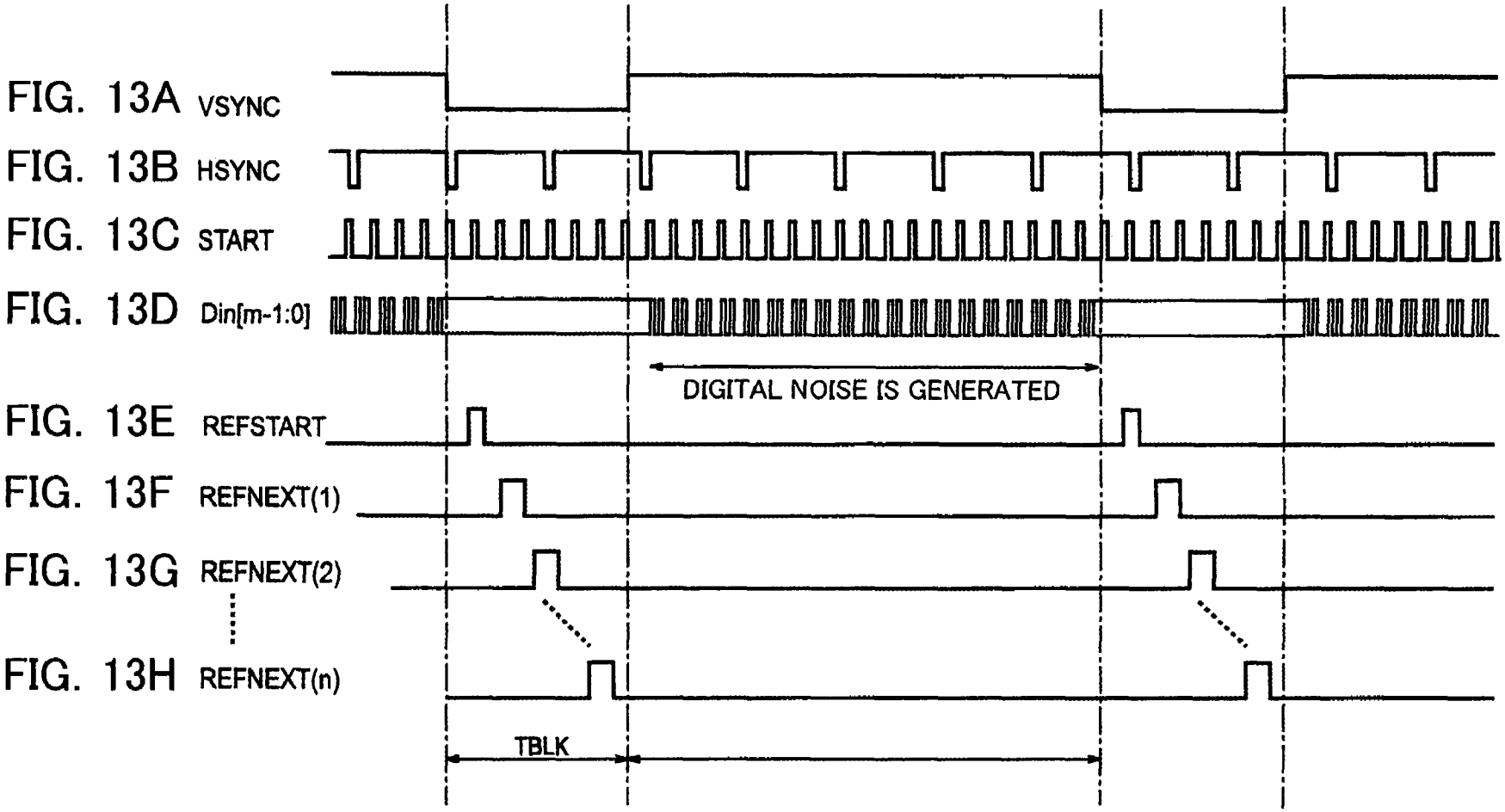
FIG. 13A to FIG. 13H are views for explaining an operation of distribution of the reference current among driver IC's.

By performing the layout in this way, the difference of luminances of portions corresponding to the left end of the driver IC and the right end of the driver IC can be made small while keeping the difference of luminances between adjacent DAC's in the driver IC small as it is. As a result, for example, as shown in FIG. 12, the luminance steps among drivers for driving the display panel by dividing the display panel 102 in the longitudinal direction (lateral direction in FIG. 4) can be made small.

FIG. 11B also shows an example of the preferred layout.

The difference of the layout of FIG. 11B from FIG. 11A resides in the point that each resistor element is actually configured by two resistor elements each having for example ½ value and laid out by cross-lacing.

By performing the layout of the resistor elements R211 and R212 of the Wilson constant current source 2031 by tuck up, the variation of the Wilson constant current source 2031 can be made small.

In the same way as above, by performing the layout of the resistor R21 of the reference current source of the DAC 800-1 at the left end of the driver IC and the resistor R28 of the reference current source of the DAC 800-8 at the right end of the driver by cross-lacing, the variation of luminances of portions corresponding to the left end of the driver IC and the right end of the driver IC can be made small. Also, other resistor elements are laid out by cross-lacing matching with them.

Further, preferably, the transistors are laid out in the same sequence as the layout of the resistor elements shown in FIG. 11A or FIG. 11B. FIG. 11C shows a bad example for comparison.

In FIG. 11C, the resistor element R221 of the reference current source 2034-1 of the DAC 800-1 at the left end of the driver IC chip is close to the resistor elements R211 and R212 of the Wilson constant current source 2031 but far from the resistor element R228 of the reference current source 2034-8 of the DAC 800-8 at the right end of the chip. Therefore, even if the difference of luminances between adjacent DAC's in the driver IC is small, the difference of luminances of portions corresponding to the left end of the driver and the right end of the driver becomes large. For this reason, when a plurality of drivers are arranged, luminance steps are easily generated between drivers.

FIG. 13A to FIG. 13H are views for explaining the operation of distribution of the reference current IREF among driver IC's.

The present display device 100 distributes the reference current IREF to the driver IC's (data line drivers) in the vertical blanking period TBLK, as shown in FIG. 13A to FIG. 13H, and the driver IC's 101-1 to **101-*n* use the current sampled and held in the current sampling circuit 202** as the substantial reference current.

In the case of, for example, a large size display panel, the interconnect of the master reference current will extend long on the display panel. For this reason, due to the crosstalk with the digital signal and the existence of impedance of the power supply system, digital noise is easily superimposed. For example, when digital noise generated along with the transfer of the image data is superimposed on the master reference current, there is the problem that the luminance variation, due to the noise, will occur when a specific pattern, by which large digital noise is generated, is displayed.

Usually, an image is not displayed on the screen in the vertical blanking period; therefore, the generation of the digital noise can be suppressed by fixing the value of the image data.

By distributing the reference current to the data line drivers in this period, reference currents having the same value on which the noise is not superimposed can be distributed.

After the vertical blanking period, the reference current led over the panel is not directly used, but the current sampled and held in the current sampling circuits 202 of the reference current source circuits 200-1 to **200-*n* of the driver IC's 101-1 to 101-*n*** is used as the reference current of each driver IC. By this method, the problem of the noise can be solved.

Further, all of the circuits sampling and holding the reference current of the driver IC's become OFF after the vertical blanking period, and the potential of the common reference current interconnect fluctuates. For this reason, preferably, a dummy circuit of the current sampling circuit 202 is provided, and the potential fluctuation of the common reference current interconnect is desirably suppressed.

Figure 14:
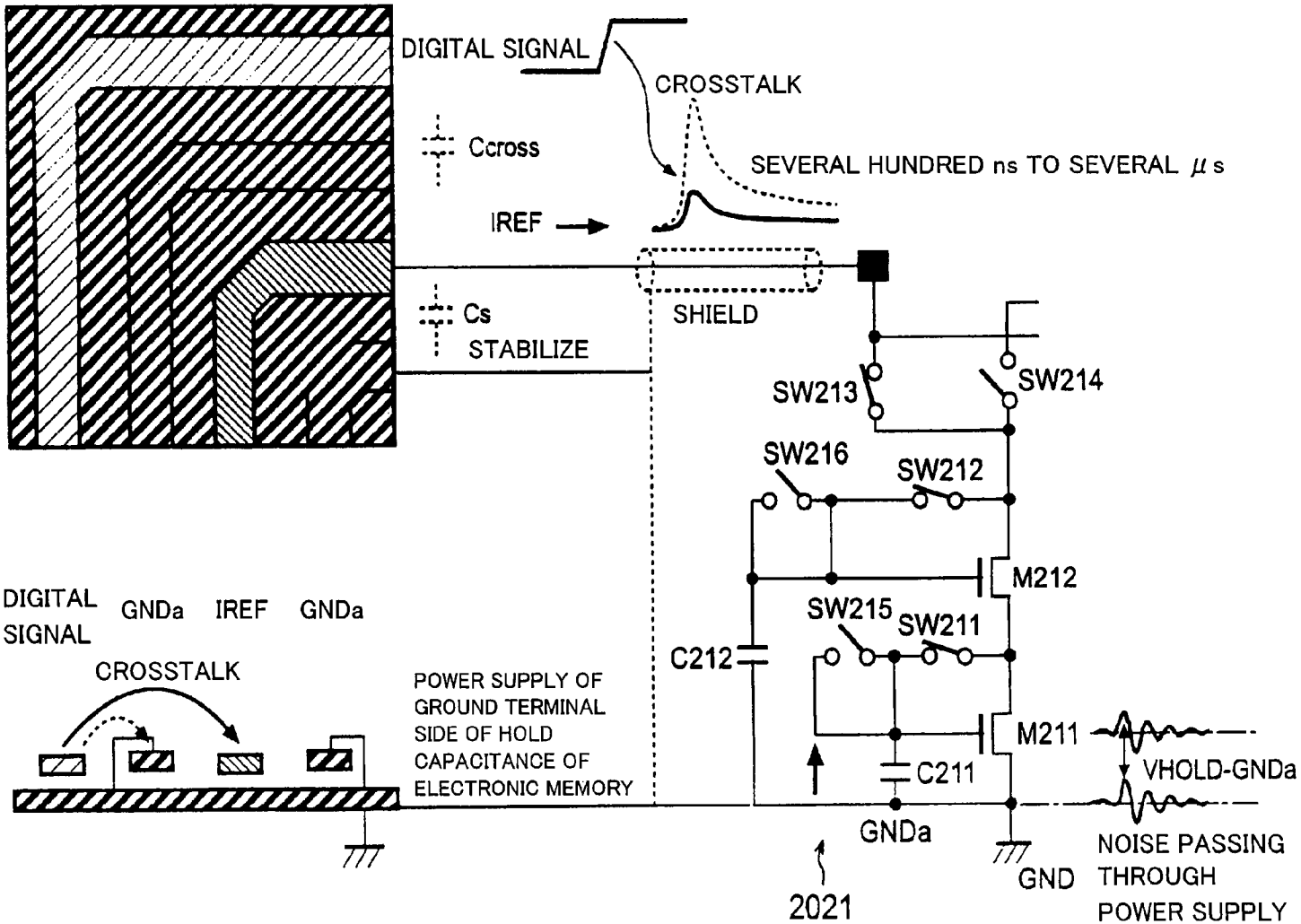
FIG. 14 is a view for explaining a shield and stabilization method of the reference current interconnects for distributing the reference current to driver IC's.

FIG. 14 is a view for explaining the shield and stabilization method of the reference current interconnect for the distribution of the reference current among driver IC's.

In the present display panel 100, the interconnect of the master reference current IREF is passed between shield use power supply interconnects.

Further, in the case of a multi-layer substrate, it is laid (interconnected) on the power supply layer for shielding. As the power supply for shielding, in, for example, the first current memory 2021 configuring the current sampling circuit 202 provided in the reference current source circuit 200, as explained above, when the diode-connected transistors M211 and M212 are n channel MOS's (NMOS's), they are connected to a ground voltage source GNDa of an analog system.

When the diode-connected transistors M211 and M212 are p channel MOS's (PMOS's), they are connected to a power supply voltage source VDDa of the analog system.

Many digital signals are input to a data line driver IC. When there is crosstalk between the interconnect of the master reference current IREF and these digital signal interconnects, the current flowing into the current sampling circuit 202 fluctuates for several hundreds ns to several is after the digital signal changes. When the current ends up being held by the current memory when it fluctuates, a luminance step ends up being generated for each data line driver driving the display panel by division.

For this reason, the interconnect of the master reference current is passed between the shield use power supply interconnects to prevent the attachment of the coupling capacitance Ccross with the digital signal interconnect as much as possible.

Further, in the case of a multi-layer substrate, by laying the interconnect of the master reference current IREF on the power supply layer for shielding, the value of the interconnect capacitance Cs is made large, and the fluctuation ΔVcross due to the crosstalk is made small.

$$\Delta V\text{cross}=(VIH-VIL)\times(C\text{cross}/Cs)\times N\text{dig}$$

$$\Delta I/I\approx 2\Delta V\text{cross}/V\text{eff} \quad (7)$$

Here, Veff is the effective voltage Veff=Vgs−Vth held in the capacitor of the current memory.

Further, in the present display panel 100, as already explained, the value of the image data is fixed in the vertical blanking period to reduce the amount of the crosstalk in distributing the reference current. Preferably, for transferring the digital data, use is made of a small amplitude transfer technology or small amplitude differential transfer technology (LVDS).

For example, in the first current memory 2021, when the diode-connected transistors M211 and M212 are NMOS's, as explained above, the IDS is determined using the ground GNDa of the analog system as a standard, therefore the ground terminals of the capacitors C211 and C212 are connected to the ground voltage source GNDa.

When the diode connected transistors M211 and M212 are PMOS's, the IDS is determined using the power supply voltage source VDDa of the analog system as a standard, therefore the ground terminals of the capacitors C211 and C212 are connected to the power supply voltage source VDDa.

For this reason, in the same way as the ground terminals of the capacitors C211 and C212, the shield use power supply interconnect uses the ground voltage source GNDa of the analog system in the case of an NMOS current memory and uses the power supply voltage source VDDa of the analog system in the case of a PMOS current memory.

When a power supply having inverse polarity is used for the shielding, even the ground voltage source GNDa and power supply voltage source VDDa of the analog system have noise of tens of mV or more and so exert an influence upon the precision when the current memory performs the sampling and holding.

During the period where the image data is transferred, each driver on the display panel 102 is operating at a high frequency. For this reason, due to the existence of the impedance of the power supply system, the power supply levels of the IC's separately fluctuate.

As in the example explained above, assuming that the master reference current is output from the driver IC 101-1 and received at the driver IC 101-*n*, for the driver IC 101-*n*, the level difference between the GNDa of the driver IC 101-1 and the GNDa of the driver IC 101-*n* seemingly overlaps the reference current as noise.

By providing the current sampling circuit 202, even if the level of the ground power supply voltage GNDa fluctuates, the gate voltage also fluctuates together by the capacitors C211 and C212 of the current memory. In the end, the gate-source voltage of the transistors M211 and M212 do not fluctuate, so a stable reference current can be supplied to the driver.

Figure 15:
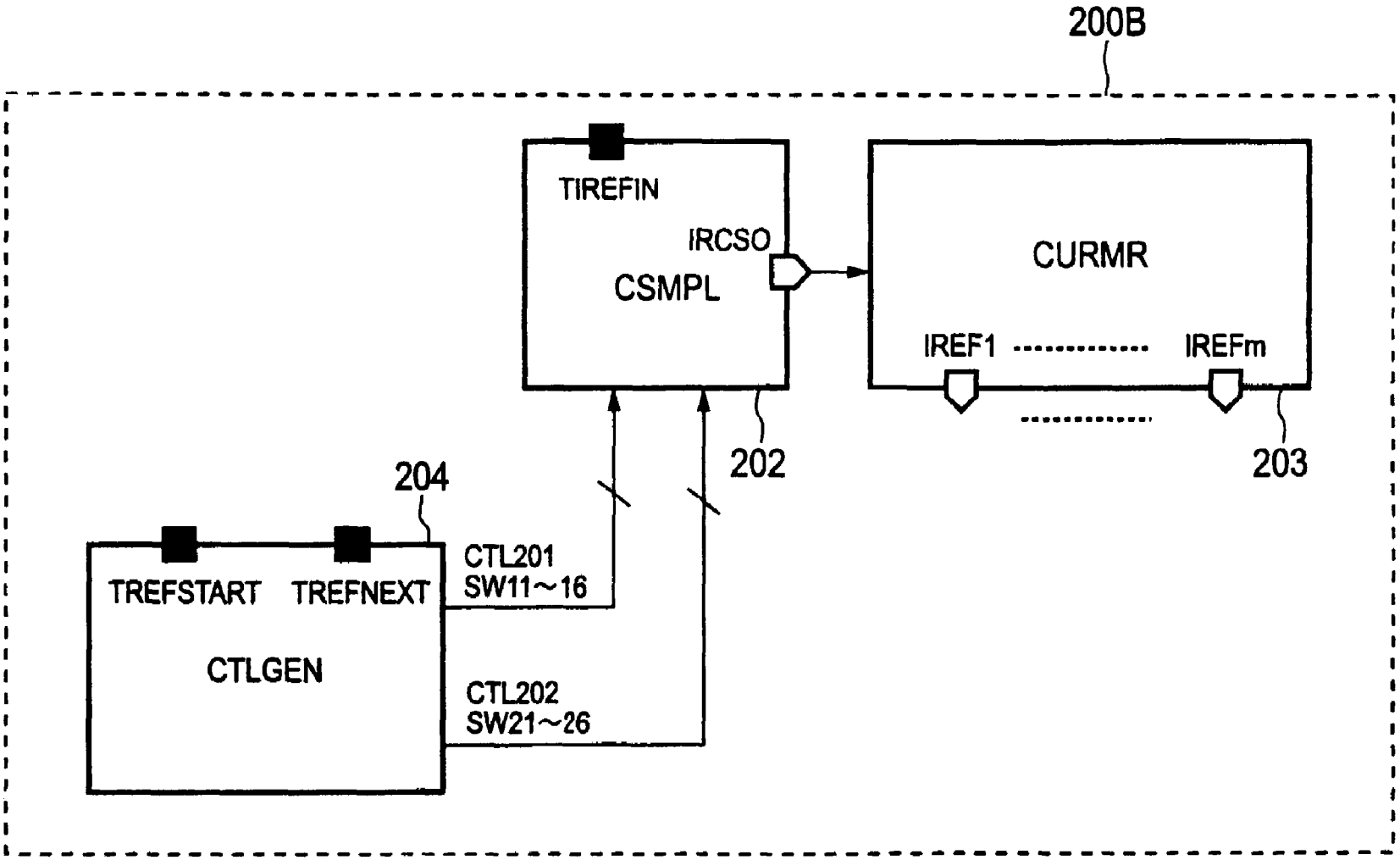
FIG. 15 is a block diagram of a second example of the configuration of a reference current source circuit according to the present embodiment.

FIG. 15 is a block diagram of a second example of the configuration of a reference current source circuit according to the present embodiment.

The difference of the present reference current source circuit 200B from the reference current source circuit 200A of FIG. 7 resides in that, in place of providing the constant current source circuit, the reference current IREF is supplied from a current source such as a constant current generation circuit or a current output type DAC separately provided on the display panel 102 for each driver IC (101-1 to n in the present embodiment).

The rest of the configuration and functions are the same as those of the circuit of FIG. 7.

Note that it is also possible to configure the system so that they are connected to a plurality of current sampling circuits in place of the current mirror circuit.

Above, a detailed explanation was given of the concrete configuration and functions of the reference current source circuit 200. Below, an explanation will be given of the functions of the remaining components of a driver IC 101.

A test circuit 1000 tests the operation of the entire circuit in response to input signals TMODE and TCLK and outputs the test output of the corresponding circuit to TOUT.

A control circuit 300 outputs drive clock signals and control signals to a write circuit 400, a flag use bi-directional shift register 500, and control signal generation circuits 700-1 to 700-(*m*/2) in response to the direction control signal DIR, a reset signal RESET, a load pulse LOAD, a latch pulse LATCH, and a clock signal MCLK.

The write circuit 400 latches input m number of bits of image data Din [m−1, 0] based on the drive clock signal and control signal from the control circuit 300, preferably lowers the operation frequency by serial/parallel conversion, and outputs the result to an image data use register array 600.

The flag use bi-directional shift register 500 shifts the flag signals (pulse signals) START/NEXT and NEXT/START input from the two ends of the shift register to any of the left or right directions according to the direction control signal DIR and the drive clock signals and control signals input from the control circuit 300. The shifted flag signal is supplied to the image data use register array 600, and the position (address) of the register array for writing the image data input from the write circuit 400 is selected.

The image data use register array (image use memory) 600 is configured by, for example, double buffer type registers and holds the image data input from the write circuit 400 in the register of the front stage. It transfers the held image data to the register of the rear stage in response to the input of the latch pulse LATCH and sequentially outputs the same to the digital/analog conversion circuits DACs 800-1 to **800-*m* in response to the channel selection signals input from the control signal generation circuits 700-1 and 700-**(*m*/2).

The DACs 800-1 to **800-*m* are current output type digital/analog conversion circuits. Namely, these conversion circuits generate the current signals corresponding to the image data sequentially input from the image data use register array 600 and output the same to the current sampling circuits configuring the current output circuits 900-1 to 900-*m*** in a time division manner.

The current output circuits 900-1, 900-2, . . . , and **900-*m* are configured by the current sampling circuits according to the present invention explained above and high withstand voltage or medium withstand voltage current output transistors according to the present invention explained above. These current output circuits sample and hold the conversion currents corresponding to the image data input from the digital/analog conversion circuits DACs 800-1, 800-2, . . . , and 800-*m*** and output the held currents to a plurality of output terminals in response to the input of the LOAD signals.

The current output type driver IC 101 of the present embodiment holds the input image data Din [m−1, 0] based on the control signal supplied from the outside. It outputs the held image data to the DAC's 800-1 to **800-*m*** according to the channel selection signals.

The digital/analog conversion circuits DAC's 800-1 to **800-*m* generate and supply the reference current IREF supplied from the reference current source circuit 200 and the current in accordance with the input image data to the current output circuits 900-1 to 900-*m*. Then, the current output circuits 900-1 to 900-*m* hold the currents supplied from the digital/analog conversion circuits DAC's 800-1 to 800-*m***, output the held currents to a plurality of output terminals in response to the input of the LOAD signal, and supply them to a plurality of data lines on the display panel (not illustrated).

Figure 16:
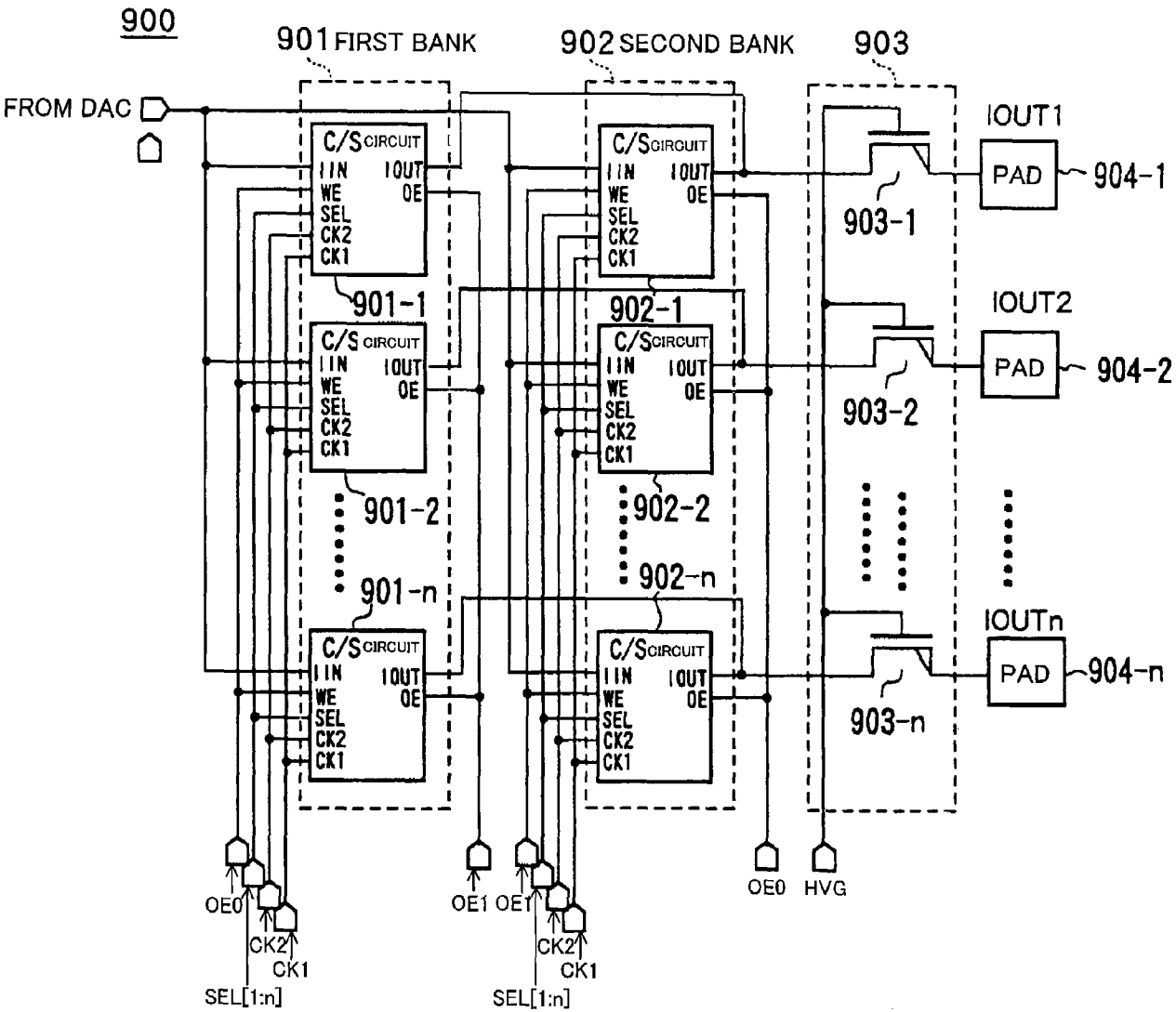
FIG. 16 is a circuit diagram of an example of the configuration of a current output circuit configuring a current output type driver IC according to the present embodiment.

FIG. 16 is a circuit diagram of an example of the configuration of a current output circuit of the present embodiment.

A current output circuit 900 has, as shown in FIG. 16, a first bank 901 and a second bank 902, each comprising a plurality of current sampling circuits, and a current output transistor array 903 comprising a plurality of transistors having predetermined withstand voltages of medium withstand voltages or high withstand voltages satisfying the voltage required for driving the display panel 102.

As shown in FIG. 16, pluralities of current sampling circuits 901-1 to **901-*n* and 902-1 to 902-*n* of exactly the number of channels of output current are arranged in the first bank 901 and the second bank 902**.

The current sampling circuits 901-1 to **901-*n* of the channels of the first bank 901 are arranged corresponding to the current sampling circuits 902-1 to 902-*n* of the channels of the second bank 902**.

Further, the current sampling circuits 901- to **901-*n* and 902-1 to 902-*n* of the channels of the first bank 901 and the second bank 902 are arranged corresponding to the transistors 903-1 to 903-*n* having the predetermined withstand voltages of channels of the current output transistor array 903**.

For example, in the first bank 901, they are arranged corresponding to the current sampling circuit 901-1 of the first channel, the current sampling circuit 902-1 of the first channel of the second bank 902, and the transistor 903-1 having the predetermined withstand voltage of the first channel in the current output transistor array 903.

The current output terminal IOUT of the current sampling circuit 901-1 and the current output terminal IOUT of the current sampling circuit 902-1 are commonly connected to the source of the transistor 903-1 having the predetermined withstand voltage.

In the same way as above, they are arranged corresponding to the current sampling circuit **901-*n* of the n-th channel of the first bank 901, the current sampling circuit 902-*n* of the n-th channel of the second bank 902, and the transistor 903-*n* having the predetermined withstand voltage of the n-th channel in the current output transistor array 903**.

The current output terminal IOUT of the current sampling circuit **901-*n* and the current output terminal IOUT of the current sampling circuit 902-*n* are commonly connected to the source of the transistor 903-*n*** having the predetermined withstand voltage.

In the current output transistor array 903, drains of the transistors 903-1, 903-2, . . . , and **903-*n*, having the predetermined withstand voltage, are connected to output pads 904-1, 904-2, . . . , and 904-*n***.

The current input terminals IIN of all current sampling circuits 901-1 to **901-*n* and 902-1 to 902-*n* of the first bank 901 and the second bank 902 are connected to the current output terminals of the current output type DAC's not shown in FIG. 16. The current sampling circuits 901-1 to 901-*n* of the first bank 901 and the current sampling circuits 902-1 to 902-*n* of the second bank 902 are alternately controlled to a writing mode and a reading mode in response to control signals OE0 and OE1**.

By these current sampling circuits 901-1 to **901-*n* and 902-1 to 902-*n*, drive currents in accordance with the output currents of the DAC's are connected to not illustrated data lines on the load side via current output transistors 903-1, 903-2, . . . , and 903-*n***.

The current output circuit 900 of the present embodiment must supply a drive current in accordance with the output current of the DAC to an organic EL element with a voltage of about 10V to 20V when driving an organic EL element.

For this reason, by providing one of the transistors 903-1 to **903-*n* having the predetermined withstand voltage of a medium withstand voltage or high withstand voltage for each output channel and outputting the output current from the current sampling circuit to the organic EL elements of channels via the pads 904-1 to 904-*n***, a high voltage is handled.

Figure 17:
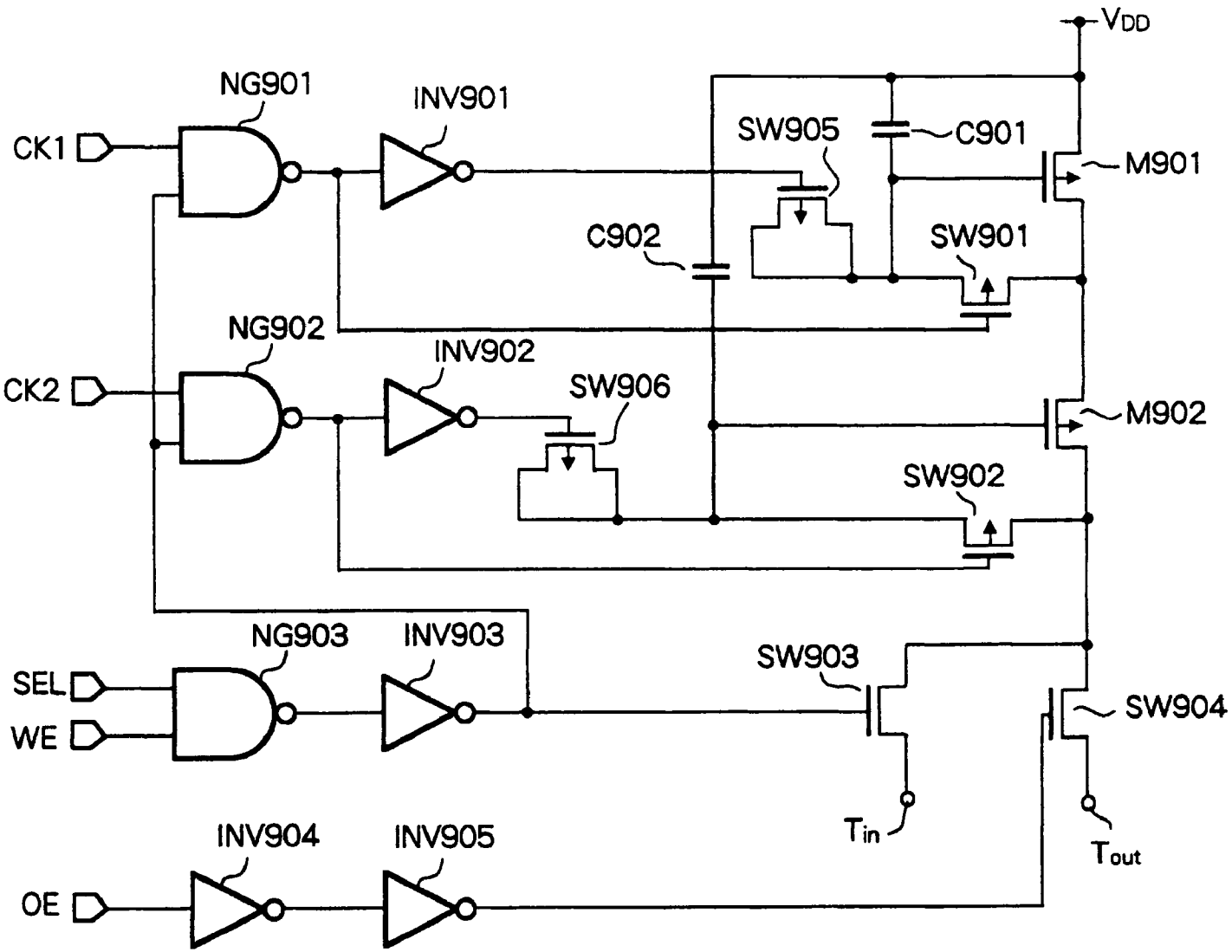
FIG. 17 is a circuit diagram of an example of the configuration of a current sampling circuit employed in first and second banks of the current output circuit.

FIG. 17 is a circuit diagram of a concrete example of the configuration of the current sampling circuits 901-1 to **901-*n* and 902-1 to 902-*n* employed in the first and second banks 901 and 902 of the current output circuit 900**.

The current sampling circuit of the present current output circuit 900 has, as shown in FIG. 17, PMOS transistors M901 and M902, switching elements SW901 to SW906, capacitors C901 and C902, 2-input NAND gates NG901 to NG903, and inverters INV901 to 905.

As shown in FIG. 17, in the current sampling circuit of the current output circuit 900, the on/off control of the switching elements SW901 and SW905 is carried out by the output signals of the NAND gate NG901 and the inverter INV901, and the on/off control of the switching elements SW902 and SW906 is carried out by the output signals of the NAND gate NG902 and the inverter INV902.

Further, the on/off state of the switching element SW903 is controlled by the output signal of the inverter INV903, and the on/off state of the switching element SW904 is controlled by the output signal of the inverter INV905.

Note that, as shown in FIG. 17, the switching elements SW901, SW902, SW905, and SW906 are configured by PMOS transistors, and switching elements SW903 and SW904 are configured by NMOS transistors.

A clock signal CK1 and the output signal of the inverter INV903 are input to the input terminal of the NAND gate NG901, and a clock signal CK2 and the output signal of the inverter INV903 are input to the input terminal of the NAND gate NG902.

A selection signal SEL and a write enable signal WE are supplied to input terminals of the NAND gate NG903.

The input terminal of the inverter INV901 is connected to the output terminal of the NAND gate NG901, and the input terminal of the inverter INV902 is connected to the output terminal of the NAND gate NG902. The input terminal of the inverter INV903 is connected to the output terminal of the NAND gate NG903.

Further, the output enable signal OE is supplied to the input terminal of the inverter INV904. The input terminal of the inverter INV905 is connected to the output terminal of the inverter INV904.

In the present current sampling circuit, when both of the selection signal SEL and the write enable signal WE are held at a high level at the time of the current writing (sampling), the output of the inverter INV903 becomes the high level, and the switching element SW903 turns ON. At this time, the clock signals CK1 and CK2 are held at a high level, therefore the outputs of the NAND gates NG901 and NG902 are held at a high level, and the outputs of the inverters INV901 and INV902 are held at a low level. At this time, the switching elements SW901, SW902, and SW903 become ON, and the other switching elements SW904, SW905, and SW906 become OFF. By this, gate voltages of the transistors M901 and M902 are input to the electrode of the capacitor C901 and the electrode of C902.

After the end of the current writing, the clock signals CK1 and CK2 are sequentially switched to the low level. In response to this, the switching elements SW901 and SW902 are sequentially switched to the OFF state. On the other hand, along with the turning off of the switching element SW901, the switching element SW905 turns on, and along with the turning off of the switching element SW902, the switching element SW906 turns on.

Then, when the write enable signal WE switches to a low level, the switching element SW903 turns off. At this time, the capacitors C901 and C902 hold the gate voltages of the transistors M901 and M902.

At the time of the current reading (current output), the output enable signal OE is held at a high level. In response to this, the switching element SW904 turns on, therefore, by voltages held in the capacitors C901 and C902, the transistors M901 and M902 carry the saturation currents determined by their gate voltages. These currents are output from output terminals Tout to the load side.

The PMOS transistor M902 of the present current sampling circuit operates as a cascode transistor; therefore, an improvement of the output current precision and a reduction of the influence, due to the variation of the load side, can be achieved.

In the present current sampling circuit, preferably, the channel width of the MOS transistor configuring the switching element SW905 is formed to about ½ of the channel width of the MOS transistor configuring the switching element SW901. Alternatively, one of three gates is used as the switching element SW905, and two of them are used as the switching element SW901. Note that, the same is true also for the MOS transistors configuring the switching elements SW902 and SW906.

When the operation mode shifts from the current writing to the holding state, it is important, for holding the correct write current, that the charges generated when turning off the switching elements SW901 and SW902 be cancelled. When the switching elements SW905 and SW906 turn on before the switching elements SW901 and SW902 turn off, the effect of cancellation becomes very small. For this reason, the switching elements SW905 and SW906 are driven by the output of the inverter after the NAND output for driving the switching elements SW901 and SW902.

According to the present current sampling circuit, the influence of the switching operation which becomes a problem when forming a semiconductor integrated circuit is reduced. The current values at the time of the current writing and the time of the current reading coincide with sufficient precision, and the influence due to the variation of the circuits on the output load side is suppressed.

As described above, in each current sampling circuit, when the selection signal SEL and the write enable signal WE are in the active state (for example, a high level), the gate voltages in response to the output currents from the DAC's are fetched into the capacitors C901 and C902 of the current sampling circuit at timings set by the clock signals CK1 and CK2 and held. Then, when the read enable signal OE is in the active state (for example a high level), a current, in accordance with the gate voltages held in the capacitors C901 and C902, is output.

For this reason, by the current output circuit 900 of the present embodiment, each current sampling circuit supplies a highly precise drive current to the organic EL element of each channel based on the output current of the DAC.

FIG. 18A to FIG. 18H are timing charts showing the operation of a current output type driver IC of FIG. 6. Below, an explanation will be given of the operation of a current output type driver IC of FIG. 6 by referring to FIG. 16 and FIG. 18A to FIG. 18H.

As shown in FIG. 16, in the current sampling circuits of the first bank 901 and the second bank 902, the write operation and the read operation are alternately controlled by the enable signals OE0 and OE1. Namely, the enable signal OE0 is input as the write enable signal WE of each current sampling circuit of the first bank 901, and the enable signal OE1 is input as the read enable signal OE. Conversely, in each current sampling circuit of the second bank 902, the enable signal OE1 is input as the write enable signal WE, and the enable signal OE0 is input as the read enable signal OE.

For this reason, when the current sampling circuit of the first bank 901 is writing, the current sampling circuit of the second bank 902 outputs the current, conversely when the current sampling circuit of the second bank 902 is writing, the current sampling circuit of the first bank 901 outputs the current. Namely, the current sampling circuit of the first bank 901 and the current sampling circuit of the second bank 902 are alternately controlled to the write mode and the read (current output) mode.

As shown in FIG. 18A to FIG. 18F, the clock signals CK1 and CK2 and the enable signals OE0 and OE1 are generated in synchronization with the latch pulse LATCH. Note that the latch pulse LATCH is generated by the system and supplied to the control signal generation circuits 700-1 and 700-($m$/2). These control signal generation circuits 700-1 and 700-($m$/2) generate the clock signals CK1 and CK2 and the enable signals OE0 and OE1 and supply them to the current output circuit 900.

As shown in FIG. 18A to FIG. 18F, in synchronization with the latch pulse LATCH, the clock signals CK1 and CK2 and the enable signals OE0 and OE1 are generated. For each cycle of the latch pulse LATCH, the enable signal OE0 and the enable signal OE1 are alternately held at the high level and the low level.

When the enable signal OE0 is at a high level, the current sampling circuit of the first bank 901 performs the writing. At this time, at the timings set up by the clock signals CK1 and CK2, the current sampling circuits 901-1, 901-2, . . . , **901-*n* of the first bank 901 supply the gate voltages of the transistors M901 and M902 to the capacitors C901 and C902** and hold them.

In the cycle of the next latch pulse LATCH, the enable signal OE0 switches to a low level, and the enable signal OE1 switches to a high level. For this reason, the current sampling circuit of the second bank 902 performs the writing, and the current sampling circuit of the first bank 901 performs reading, that is, current output.

Figure 18:
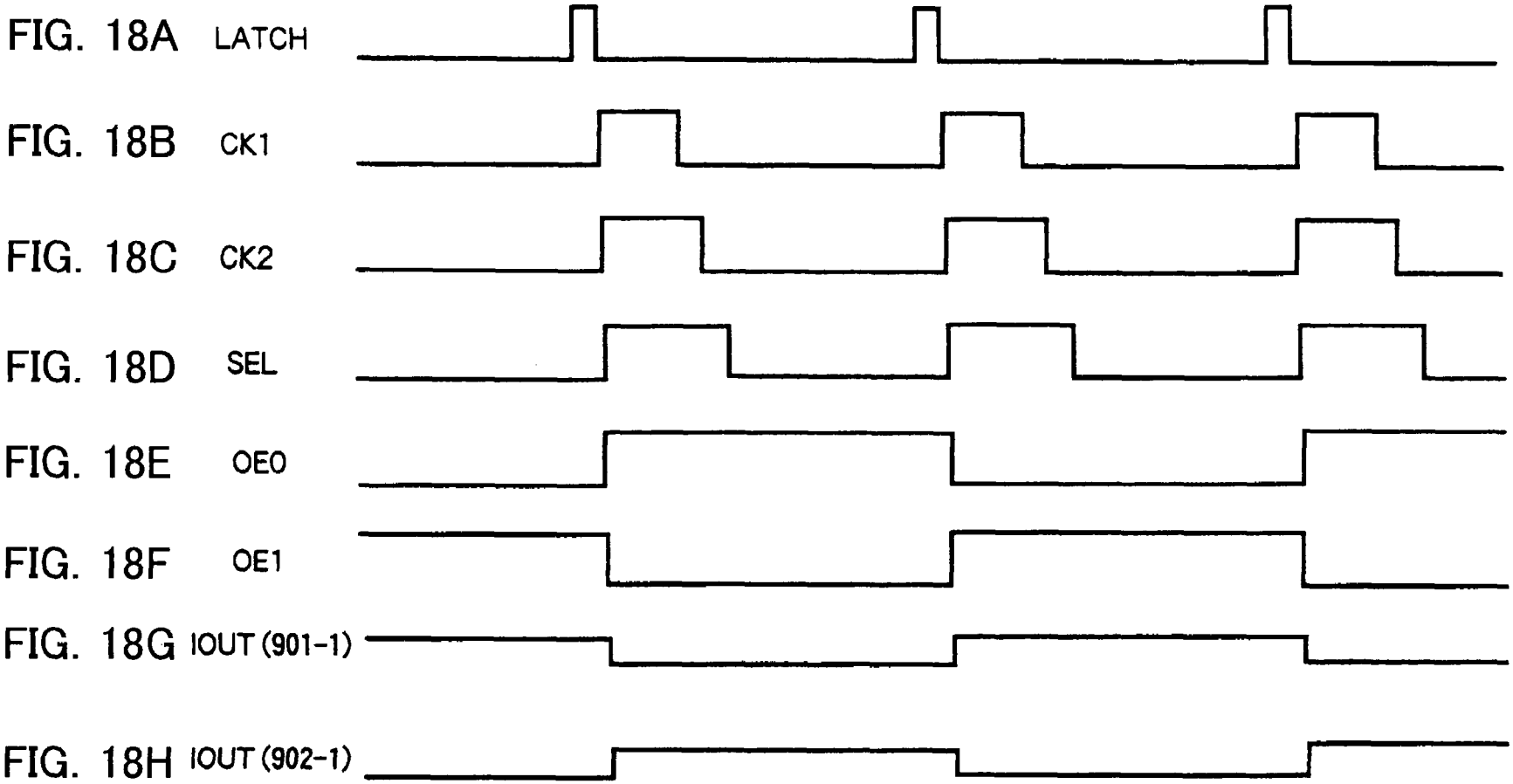
FIG. 18A to FIG. 18H are timing charts showing the operation of a current output type driver IC according to the present embodiment.

As shown in FIG. 18G and FIG. 18H, at this time, for example, the current is output from the current output terminal IOUT of the current sampling circuit 901-1 of the first bank 901.

As explained above, in the current output circuit 900 of the present embodiment, in response to the enable signals OE0 and OE1, the current sampling circuit of the first bank 901 and the current sampling circuit of the second bank 902 are alternately controlled to the writing mode and the reading mode, the current sampling circuit performs writing in response to the output current from the DAC in the writing mode and outputs the current held at the time of the writing mode operation in the reading mode and, therefore, supplies the current in response to the output current of the DAC to the load side with a high precision.

Figure 19:
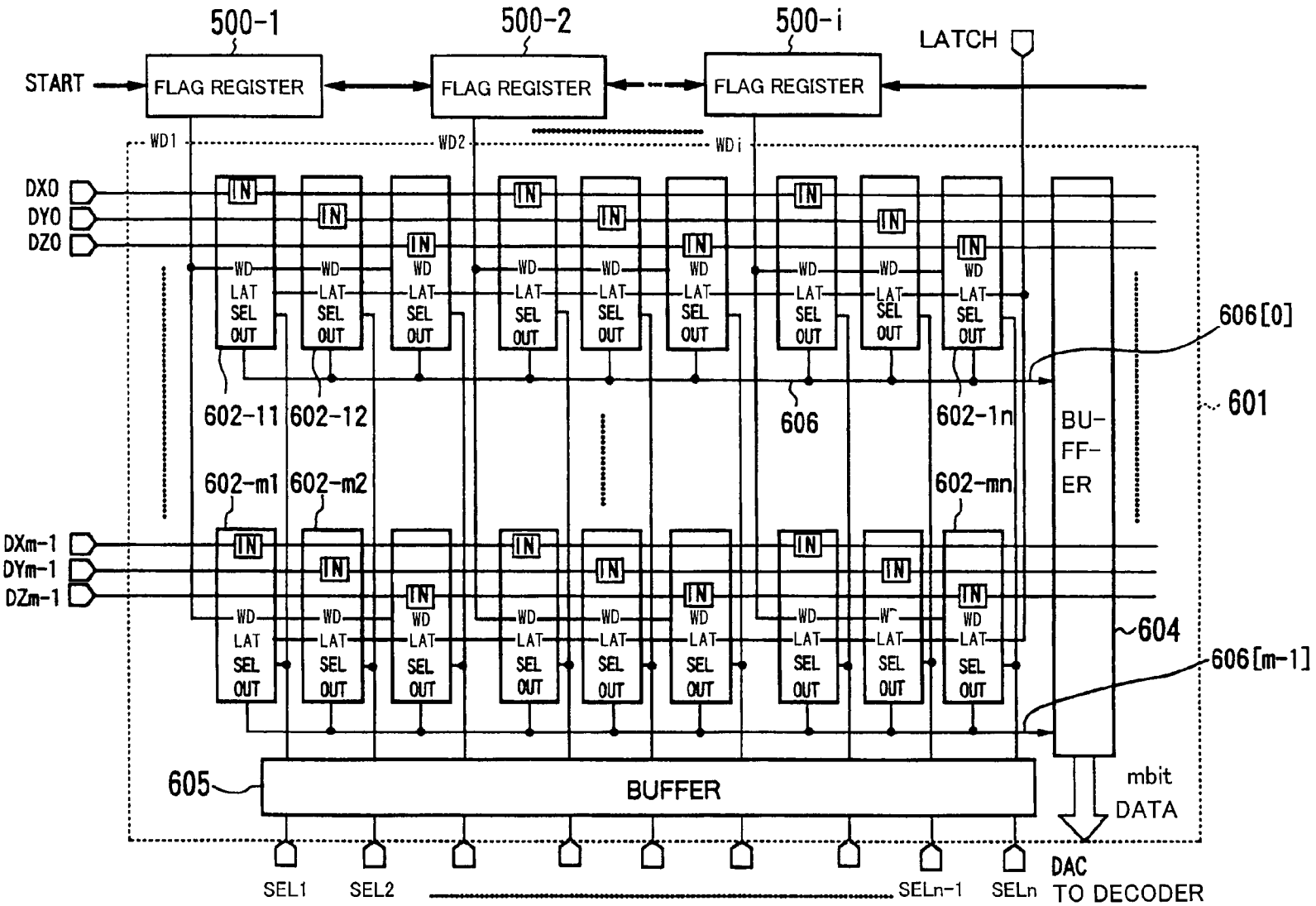
FIG. 19 is a circuit diagram of an example of the configuration of a register array configuring a current output type driver IC according to the present embodiment.

FIG. 19 is a circuit diagram of an example of the configuration of the register array 600 (image memory) in the current output type driver IC 101 of FIG. 6.

Note that the example of the circuit shown in FIG. 19 is a partial circuit of the register array corresponding to the one DAC in FIG. 6. In the following explanation, this partial circuit will be explained as a register array assigned the reference numeral 600 for convenience.

As shown in FIG. 19, unit cells configuring the register array 600 are for example double buffer type latch circuits 602-11, 602-12, . . . , **602-1*n* to 602-*m*1, 602-*m*2, . . . , and 602-*mn*** in which two stages of D-type latch circuits having transmission gates are connected.

The latch circuits 602-11 to **602-*mn*** configure an n×m array wherein the channel number n of the current sampling circuit connected to the output of one DAC is the word number, and the bit width m of the image data is the bit width.

In the latch circuits 602-11 to **602-*mn*, the transmission gate of the latch circuit of the former stage is turned on/off by outputs WD1, WD2, . . . , WDi of the flag registers 500-1, 500-2, . . . , and 500-*i***.

In such a configuration, for example, the start pulse signal START is input to the flag register 500-1. Further, the image data are output via the writing circuit to data buses DX0 to DXm-1, DY0 to Dym-1, and DZ0 to DZm-1 inside the driver IC.

By sequential shifting of the start pulse signal START by the flag registers 500-1, 500-2, . . . , and **500-*i***, for example, among two stage-connected double buffer type latch circuits, the image data are written into the latch circuit of the former stage in an amount of three channels each.

When the writing of the image data ends, by the input of the latch pulse LATCH, in each double buffer type latch circuit, the image data held in the latch circuit of the former stage is output to the latch circuit of the latter stage. The output portion of the latch circuit of the latter stage becomes the selection circuit, and the output of each selection circuit is connected to the corresponding bit line of the common data bus 600 [*m*−1,0]. The data bus 606 [*m*−1, 0] is connected to the input side of the buffer 604. The output terminal of the buffer 604 is connected to the input terminal of the decoder of the DAC. Namely, the output of the double buffer type latch circuit is input via the buffer 604 to the decoder of the DAC.

Which latch circuit's output among the double buffer type latch circuits **602-*i*1, 602-*i*2, . . . , and 602-*in* is output to the buffer 604 is controlled by the selection signals SEL1, SEL2**, . . . , and SELn input to the selection circuits of the latter stages of the double buffer type latch circuits.

As shown in FIG. 16, the selection signals SEL1, SEL2, . . . , and SELn are input to the buffer 605, and the selection signals buffered by the buffer 605 are output to the double buffer type latch circuits 602-11, 602-12, . . . , **602-1*n* to 602-*m*1, 602-*m*2, . . . , and 602-*mn***.

Figure 20:
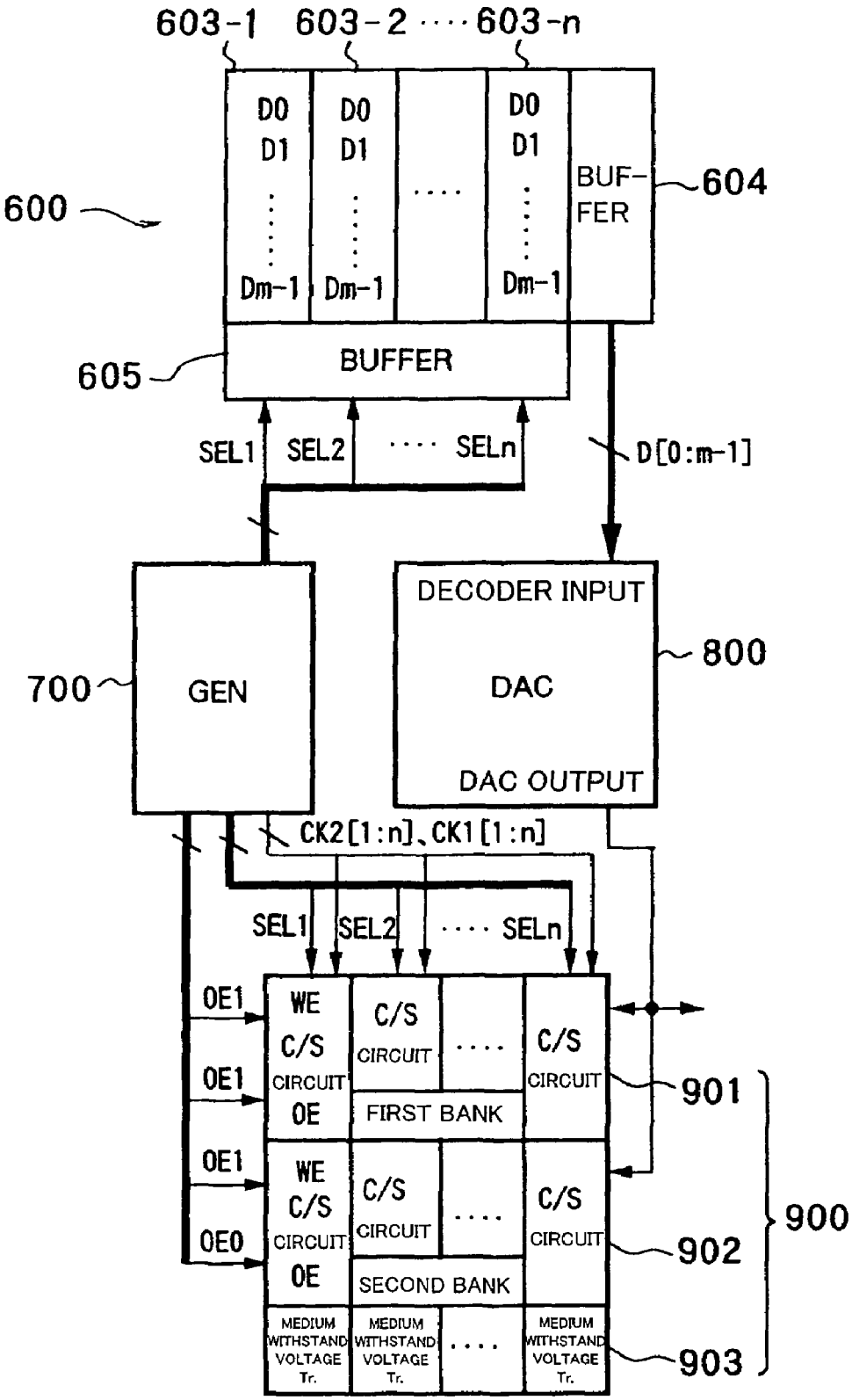
FIG. 20 is a block diagram of the configuration of a partial circuit including a register array, a control signal generation circuit, a DAC, and a current output circuit configuring a current output type driver IC according to the present embodiment.
Figures 21A, 21B, 21C, 21D, 21E, 21F, 21G:
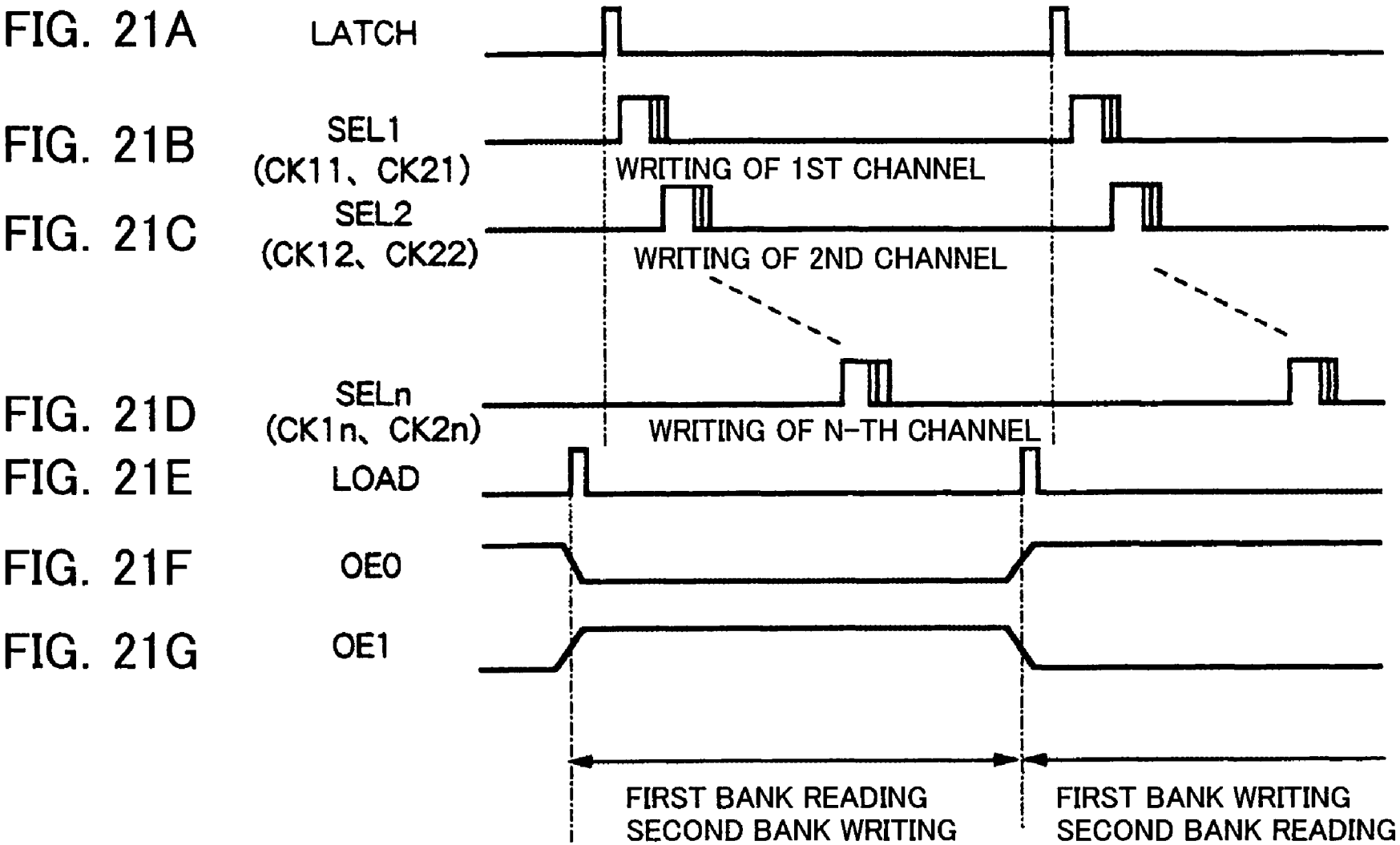
FIG. 21A to FIG. 21G are timing charts showing the operation of the partial circuit of a current output type driver IC according to the present embodiment.

Further, FIG. 20 is a block diagram of the configuration of the partial circuit including the register array 600, the control signal generation circuit 700, the DAC 800, and the current output circuit 900 of FIG. 6.

In the configuration of FIG. 20, the series of operations of reading the digital image data from the register array 600 in a time division manner, outputting the current in accordance with the image data by the DAC 800, and writing the same into the current output circuit 900 one after another is carried out. The control signal generation circuit 700 generates control signals for controlling this series of operations and outputs the same to the components of the current output type drive circuit.

For example, the input side of the decoder of the DAC 800 is connected to n number of channels' worth of register arrays 603-1, 603-2, . . . , and **603-*n* via the selection circuits and the output buffer 604. The output side of the DAC 800 is connected to the current output circuit 900 for outputting n number of channels' worth of currents I01, I02, . . . , and I0*n*. Which channel of image data is selected from the register array 600 and output to the DAC 800 is controlled by the selection signals SEL1, SEL2, . . . , and SELn generated by the control signal generation circuit 700. The image data of the selected channel is input from the register array 600 to the decoder of the DAC 800, converted to the current output by the DAC 800, and written into the current output circuit 900**.

In the current output circuit 900, as shown in FIG. 20, the current sampling circuits of the first bank 901 and the current sampling circuits of the second bank 902 repeat the writing mode and the reading mode in response to the enable signals OE0 and OE1, alternately switching between a high level and low level input from the control signal generation circuit 700, fetch the currents output from the DAC's 800, and, further, output the same via the current output transistors to not illustrated image display elements (not illustrated), for example, organic EL elements.

FIG. 21A to FIG. 21G are timing charts showing the operation of the components. Below, an explanation will be given of the basic operation of this circuit group by referring to FIG. 20 and FIG. 21A to FIG. 21G.

In each operation cycle, the input of the latch pulse LATCH clears the control signal generation circuit 700 and starts the operation.

As shown in FIG. 21A to FIG. 21G, after the latch pulse LATCH, the selection signals SEL1, SEL2, . . . , and SELn are sequentially generated from the control signal generation circuit 700. Further, together with the selection signals, clock signals CK11, CK12, CK21, CK22, . . . , CK1*n*, and CK2*n*, supplied to the channels, are sequentially generated.

The selection signals SEL1, SEL2, . . . , and SELn are supplied to the register array 600, and image data of channels held in the register array 600 are sequentially read out and input to the decoders of the digital/analog conversion circuits DAC's 800.

By the DAC 800, the input image data is converted to the current output one after another and output to the current output circuit 900. In the current output circuit 900, between the first bank 901 and the second bank 902, one is controlled to the writing mode and the other is controlled to the reading mode by the enable signals OE0 and OE1. The currents output from the DAC's 800 are sequentially written into the current sampling circuits existing in the bank on the writing mode side in response to the channel selection signals SEL1, SEL2, . . . , and SELn.

Note that the current sampling circuits is supplied, simultaneously with the channel selection signals, with a first clock signal group CK11, CK12, . . . , and CK1*n* for turning off the first switch circuits previously and a second clock signal group CK21, CK22, . . . , and CK2*n* for turning off the second switch circuits with a time lag from the first switch circuits. It is also possible if these selection signals are not made uniform for each channel, the number of interconnects is decreased in the form of combining some types of selection signals, or clock signals are not made uniform for each channel, but two or three sets of signals are commonly used.

As shown in FIG. 21A to FIG. 21G, when the load pulse LOAD is input from the outside, signals of OE0 and OE1, for controlling the switching between the writing mode and the reading mode, invert and alternately switch between the low level and the high level. When the enable signal OE0 is at a low level and the enable signal OE1 is at a high level, the current sampling circuit of the first bank 901 operates in the current reading mode and outputs the current, and the current sampling circuit of the second bank 902 operates in the writing mode and fetches the output current from the DAC. On the other hand, when the enable signal OE0 is at a high level and the enable signal OE1 is at a low level, the current sampling circuit of the second bank 902 operates in the reading mode, the held current is output from each current sampling circuit, and the current sampling circuit of the first bank 901 operates in the writing mode and fetches the output current from the DAC.

As described above, by providing the control signal generation circuit for controlling the current writing in a time division manner in the current sampling circuit using a current sampling circuit having sufficient current output precision and further by employing the method of writing the output current of the current output type D/A conversion circuit into a plurality of current sampling circuits in a time division manner, it becomes possible to decrease the number of D/A conversion circuits and lay out the multi-bit DAC.

As explained above, according to the first embodiment, by using the current sampling circuit, the master reference current can be commonly used; therefore, the luminance steps among drivers driving the display by division can be made sufficiently small, and the number of interconnects of the reference current on the display panel can be decreased.

Further, by fixing the signal of the image data in the vertical blanking period and distributing the same to the data line drivers, the influence of the crosstalk of the digital signal upon the reference current can be greatly reduced. Further, when the image data is transferred, by using the reference current held in the current sampling circuit provided in the reference current source circuit of each driver, the influence of noise during the operation can be made small.

From the above description, a large size, high gradation organic El display can be realized by the display device according to the present embodiment.

Second Embodiment

Figure 22:
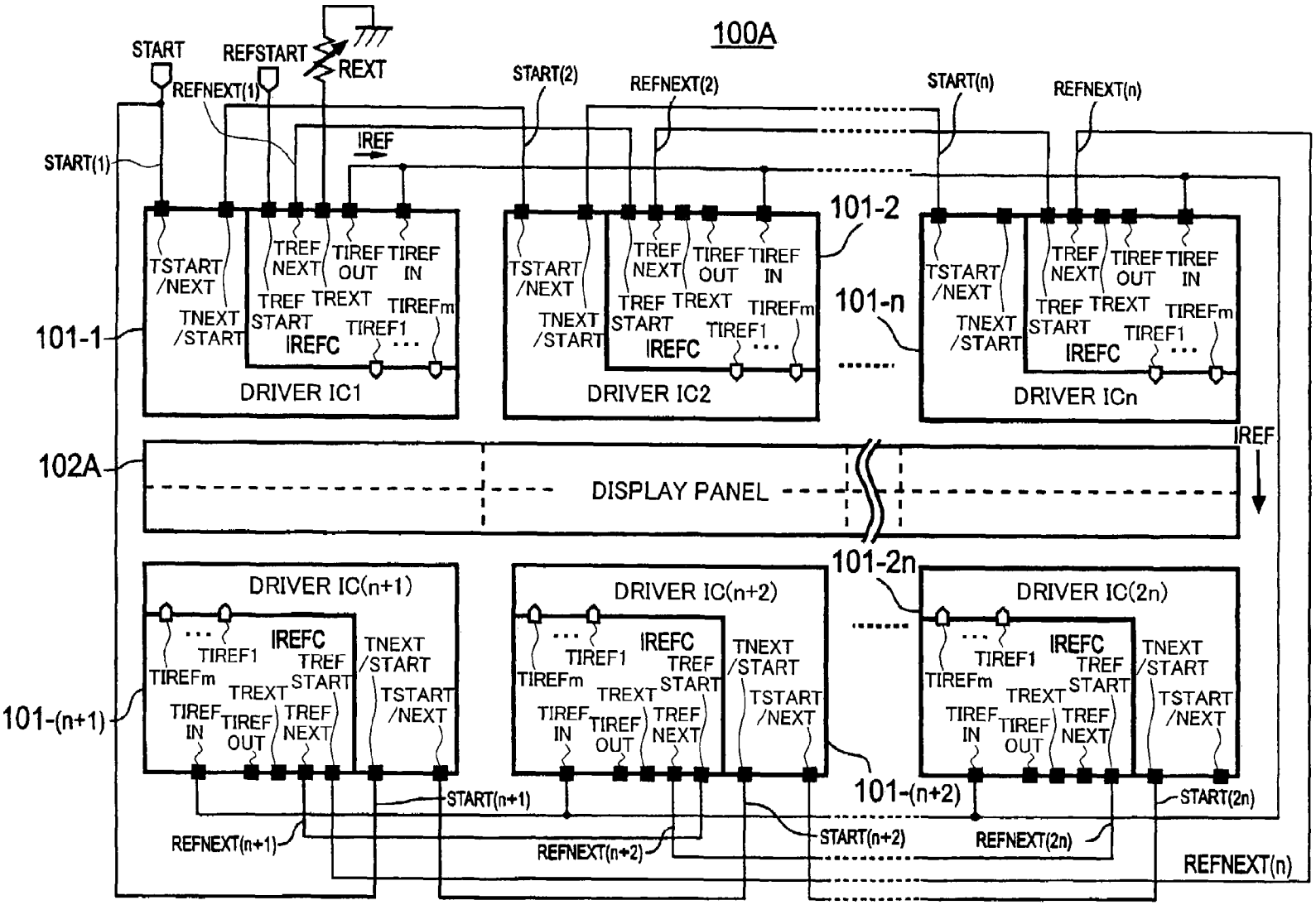
FIG. 22 is a view of the configuration of a second embodiment of an organic EL display device employing a current output type drive circuit according to the present invention.

FIG. 22 is a view of the configuration showing a second embodiment of an organic EL display device according to the present invention.

The difference of the second embodiment from the first embodiment resides in the point that a display panel 102A is divided in the longitudinal direction (lateral direction) in the figure and further divided also vertically and driven by driver IC's 101-1 to 101-*n* and 101-(*n*+1) to 101-(2*n*) from both of the top and the bottom.

In the second embodiment, the display panel 102A is driven so that the upper half in the figure is driven divided by n number of driver IC's 101-1 to 101-*n*, and the lower half is driven divided by n number of driver IC's 101-(*n*+1) to 101-(2*n*) in the same way.

This configuration is preferred in the case of a large size display.

In the second embodiment as well, the reference current is fetched in the sequence of the driver IC's 101-1 to 101-(2*n*), therefore, preferably, the flag for fetching the reference current is moved by the input terminal TREFSTART and the output terminal TREFNEXT, so these input/output terminals are sequentially connected.

It is also possible not to employ this method, but to configure the system to provide a control terminal indicating the sampling period and centrally control the operation by a control use IC provided on the panel.

Further, the present display device 100A drives the display panel 102 by dividing it by a plurality of driver IC's 101-1 to 101-*n*, 101-(*n*+1) to 101-(2*n*) in the same way as the first embodiment and so sequentially writes the image data into a plurality of driver IC's.

For this reason, the input/output terminals TSTART/NEXT and TNEXT/START, for transferring the flag indicating the write position between driver IC's, are provided.

Then, the input/output terminal TSTART/NEXT of the master driver IC 101-1 of the initial stage is connected to the input end of the pulse signal START indicating the start of transfer of the image data, and the input/output terminal TNEXT/START is connected to the input/output terminal TSTART/NEXT of the driver IC 101-2 of the next stage. The input/output terminal TNEXT/START of the driver IC 101-2 is connected to the input/output terminal TSTART/NEXT of the not illustrated driver IC 101-3 of the next stage.

Below, in the same way as the above, the input/output terminal TNEXT/START of the driver IC 101-(2*n*−1) is connected to the input/output terminal TSTART/NEXT of the driver IC 101-(2*n*) of the final stage.

In such a configuration, by, for example, a write direction control signal DIR (not illustrated), when DIR=H (logical high level), the input/output terminal TSTART/NEXT functions as the START input, the TNEXT/START terminal functions as the NEXT output, the flag moves from the left to right of the driver IC in the figure, and the image data is written (driver IC's 101-1 to 101-*n* of upper side of the display panel).

Further, when DIR=L (logical low level), the input/output terminal TNEXT/START functions as the START input, the input/output terminal TSTART/NEXT functions as the NEXT output, the flag moves from the right to left (from the left to right in the display panel) of the driver IC in the figure, and the image data is written (drivers 101-($n$+1) to 101-(2$n$) on lower side of the display panel).

Here, an explanation will be given of the sampling and transfer operation of the reference current in the display panel 100A of FIG. 22 with reference to the timing charts of FIG. 23A to FIG. 23N. Note that the following explanation of operation is only an example. It is also possible to configure the system so as to centrally control the operation by a control use IC provided on the panel.

In this case, the driver IC's 101-1 to 101-$n$ at the upper side of the display panel are supplied with a not illustrated write direction control signal DIR=H (logic: high level), the input/output terminal TSTART/NEXT functions as the START input, and the input/output terminal TNEXT/START functions as the NEXT output.

Contrary to this, the drivers 101-($n$+1) to 101-(2$n$) at the lower side of the display panel are supplied with a write direction control signal DIR=L (logic: low level) (not illustrated), the input/output terminal TSTART/NEXT functions as the NEXT input, and the input/output terminal TNEXT/START functions as the START output.

Figures 23A, 23B, 23C, 23D, 23E, 23F, 23G, 23H, 23I, 23J, 23K, 23L, 23M, 23N:
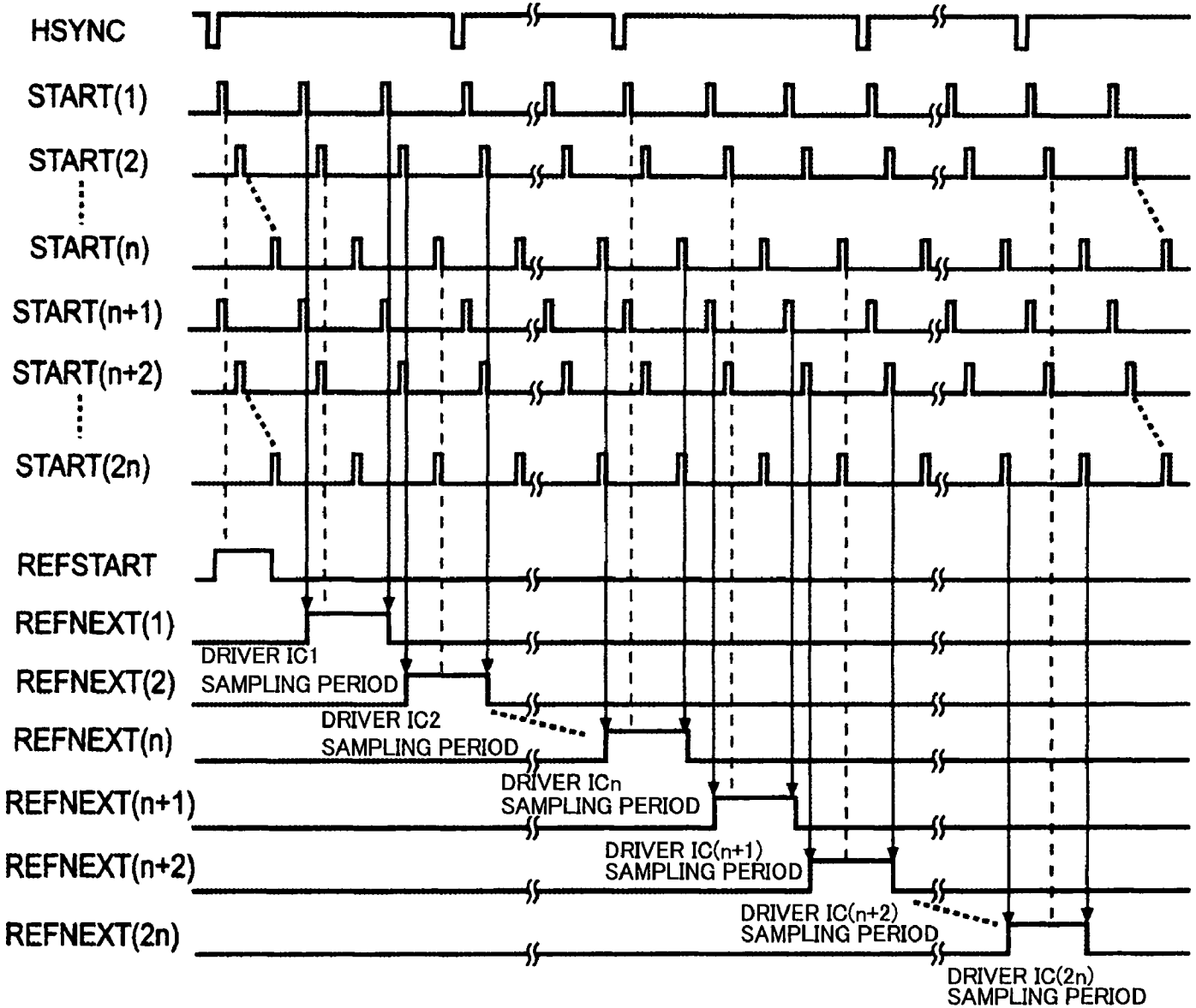
FIG. 23A to FIG. 23N are views for explaining a sampling and transfer operation of a reference current in the display device of FIG. 22.

Here, as shown in FIG. 23A, after the (downward) pulse of the horizontal synchronization signal HSYNC is input, as shown in FIG. 23B and FIG. 23E, the pulse signal START pulse=START (1) pulse=START (n+1), indicating the start of transfer of the image data, is input to the input/output terminal TSTART(/NEXT) of the driver IC 101-1 and the input/output terminal T(NEXT/) START of the driver IC 101-($n$+1).

When the flag moves in the driver IC 101-1 and ends the writing into the image data use memory of the driver IC 101-1, the pulse signal START(2), indicating the start of writing of the driver IC 101-2, is output from the input/output terminal TNEXT(/START) of the driver IC 101-1 to the input/output terminal TSTART(/NEXT) of the driver IC 101-2. By this, the flag moves to the driver IC 101-2 and the image data is written into the image data use memory of the driver IC 101-2.

In the same way as above, when the flag moves in the driver IC 101-($n$+1) and ends the writing into the image data use memory of the driver IC 101-($n$+1), the pulse signal START (n+2), indicating the start of writing of the driver IC 101-($n$+2), is output from the input/output terminal TSTART(/NEXT) of the driver IC 101-($n$+1) to the input/output terminal T(NEXT/)START of the driver IC 101-($n$+2). By this, the flag moves to the driver IC 101-($n$+2) and the image data is written into the image data use memory of the driver IC 101-($n$+2).

In the same way as above, pulse signals START (3) to START (n) and START (n+3) to START (2$n$) are successively output and the image data are written into the image data use memories of driver IC's 101-3 to 101-$n$, and 101-($n$+3) to 101-(2$n$).

Further, as shown in FIG. 23H, the pulse signal REFSTART, indicating the start of distribution of the reference current IREF, is input to the input terminal TREFSTART of the driver IC 101-1.

The pulse signal REFSTART is input so as to overlap the pulse START (1) as shown in FIG. 23B and FIG. 23H. The driver IC 101-1 latches the pulse signal REFSTART, using the pulse signal START (1) as the drive clock, and outputs the signal REFNEXT (1) pulse of 1 cycle width from the output terminal TREFNEXT terminal at the trailing edge of the pulse signal START (1) after 1 cycle. The driver IC 101-1 fetches the reference current IREF from the reference current input terminal IREFIN at the time of generation of the pulse signal REFNEXT (1) pulse.

The pulse signal REFNEXT (1) is input to the input terminal TREFSTART of the driver IC 101-2. The pulse signal REFNEXT (1) overlaps the pulse signal START (2), as shown in FIG. 23C and FIG. 23I. The driver IC 101-2 latches the pulse signal REFNEXT (1), using the pulse signal START (2) as the drive clock, and outputs the pulse signal REFNEXT (2) of 1 cycle width from the output terminal TREFNEXT at the trailing edge of the pulse signal START (2) after 1 cycle. The driver IC 101-2 fetches the reference current IREF from the reference current input terminal TIREFIN at the time of the generation of the pulse signal REFNEXT (2).

In the same way as above, pulses of REFNEXT (3) to REFNEXT (2$n$) are sequentially output from the driver IC's 101-3 to 101-(2$n$−1), and the reference current IREF is sequentially fetched into the driver IC's 101-3 to 101-(2$n$).

In the second embodiment, the rest of the configuration and functions are the same as those of the first embodiment.

According to the second embodiment, there are the advantages that not only can the same effects as the effects of the first embodiment be obtained, but also the embodiment can be preferably applied to a large size display.

INDUSTRIAL APPLICABILITY

The current output type drive circuit of the present invention can make the luminance steps among drivers driving the panel by division sufficiently small, can decrease the number of interconnects of the reference current on the display panel, can make the influence of the crosstalk of a digital signal upon the reference current small, can reduce the influence of noise during the operation, and therefore, can be applied to a large size, high gradation organic EL display.

LIST OF REFERENCES

100 . . . organic EL display device
101, 101-1 to 101-$n$ . . . current output type data line driver (driver IC)
200 (-1 to -n), 200A, 200B . . . reference current source circuit (IREFC)
300 . . . control circuit (CTL)
400 . . . write circuit (WRT)
500 . . . flag use bi-directional shift register (FSFT)
600 . . . image data use register array (REGARY)
700-1, 700-($m$/2) . . . control signal generation circuit (GEN)
800-1 to 800-$m$ . . . current output type DAC (digital/analog converter)
900-1 to 900-$m$ . . . current output circuit (IOUT)
901 . . . first bank
902 . . . second bank
903 . . . current output transistor array
1000 . . . test circuit (TST)

The invention claimed is:

1. A current output type drive circuit for outputting a drive current to a driven object shared by being divided into a plurality of areas, comprising a plurality of drivers arranged corresponding to each the shared area of the driven object, each driver comprising an output means for outputting a supplied reference current and the drive current corresponding to image data to a corresponding shared area of the driven object and a reference current source circuit for sampling and holding the reference current input from a reference current input terminal, then supplying the same to the output means, wherein each driver is a driver outputting currents of a plurality of channels in accordance with input data, further comprises a register array for holding said input data, and further comprises means for increasing the reference current sampled and held by the reference current source circuit to a plurality of reference currents by further copying or distributing them by time division, and said output means comprises a plurality of conversion circuits for receiving said plurality of reference currents and outputting currents in accordance with the data held by the register array and a current output circuit comprising a first group of current sampling circuits and a second group of current sampling circuits operating alternately in a current write mode and current read mode in accordance with the output currents of the conversion circuits.

2. A current output type drive circuit as set forth in claim 1, wherein said reference current source circuit comprises at least:

a current sampling circuit including a current memory for sampling and holding said reference current in accordance with a control signal and a control circuit for outputting to said current sampling circuit a control signal for controlling write and read operations of said reference current of the current memory of said current sampling circuit.

3. A current output type drive circuit as set forth in claim 2, wherein said output means includes a plurality of current output type digital/analog conversion circuits and the circuit comprises means for increasing the reference current read from the current memory of the current sampling circuit of said reference current source circuit to a plurality of reference currents by further copying or distributing them by time division, and said plurality of reference currents are supplied to said plurality of digital/analog conversion circuits.

4. A current output type drive circuit as set forth in claim 1, wherein said input data is digital image data, the circuit comprises means for distributing the reference current to the drivers in a vertical blanking period during which operations on said image data are suspended, and each driver uses as the reference current the current held in the reference current source circuit of the driver after the vertical blanking period in which digital noise is generated along with transfer of said image data.

5. A current output type drive circuit for outputting a drive current to a driven object shared by being divided into a plurality of areas, comprising a plurality of drivers arranged corresponding to each the shared area of the driven object, each driver comprising an output means for outputting a supplied reference current as a drive current to the corresponding shared area of the driven object and a reference current source circuit for sampling and holding a reference current input from a reference current input terminal, then supplying the same to the output means, the reference current input terminal being connected to a reference current input terminal of another driver by a common current interconnect, and the reference current being distributed to the reference current source circuits of the drivers by time division, wherein each driver is a driver outputting currents of a plurality of channels in accordance with input data, further comprises a register array for holding said input data, and further comprises means for increasing the reference current sampled and held by the reference current source circuit to a plurality of reference currents by further copying or distributing them by time division, and said output means comprises a plurality of conversion circuits for receiving said plurality of reference currents and outputting currents in accordance with the data held by the register array and a current output circuit having a first group of current sampling circuits and a second group of current sampling circuits operating alternately in a current write mode and current read mode in accordance with the output currents of the conversion circuits.

6. A current output type drive circuit as set forth in claim 5, wherein each driver fetches said reference current from said reference current input terminal to said reference current source circuit when receiving a signal indicating start of distribution of the reference current and outputs the signal indicating the start of distribution of reference current to the driver circuit of the next stage.

7. A current output type drive circuit as set forth in claim 6, wherein each driver comprises a data memory, writes input data into said data memory when receiving a first signal indicating start of writing of data and outputs said first signal indicating start of writing of data to the driver of the next stage and fetches said reference current from said reference current input terminal to said reference current source circuit in synchronization with said first signal when receiving a second signal indicating start of distribution of reference current and outputs said second signal indicating start of distribution of reference current to the driver circuit of the next stage.

8. A current output type drive circuit as set forth in claim 5, wherein said reference current source circuit comprises at least:

a current sampling circuit including a current memory for sampling and holding said reference current in accordance with a control signal and a control circuit for outputting to said current sampling circuit a control signal for controlling write and read operations of said reference current of the current memory of said current sampling circuit.

9. A current output type drive circuit as set forth in claim 8, wherein said output means includes a plurality of current output type digital/analog conversion circuits and the circuit comprises means for increasing the reference current read from the current memory of the current sampling circuit of said reference current source circuit to a plurality of reference currents by further copying or distributing them by time division, and said plurality of reference currents are supplied to said plurality of digital/analog conversion circuits.

10. A current output type drive circuit as set forth in claim 9, wherein said means increasing said reference current to a plurality of reference currents comprises a current mirror circuit configured by a constant current source including resistor elements arranged at the input stage and a plurality of reference current sources including resistor elements arranged at the output stage in parallel so as to correspond to the output parts of said output means, and the resistor elements of the reference current sources arranged at the two ends among said plurality of reference current sources are arranged close to the resistor elements of said constant current source.

11. A current output type drive circuit as set forth in claim 10, wherein the resistor elements forming the reference current sources are laid out divided and cross-laced.

12. A current output type drive circuit as set forth in claim 8, wherein at least the reference current source circuit of the driver serving as a master includes a reference current source circuit generating a reference current and supplying it to said common current interconnect.

13. A current output type drive circuit as set forth in claim 5, wherein at least the reference current source circuit of the driver serving as a master includes a reference current source circuit generating a reference current and supplying it to said common current interconnect.

14. A current output type drive circuit as set forth in claim 5, wherein said input data is digital image data, the circuit comprises means for distributing the reference current to the drivers in a vertical blanking period during which operations on said image data are suspended, and each driver uses as the reference current the current held in the reference current source circuit of the driver after the vertical blanking period in which digital noise is generated along with transfer of said image data.

15. A current output type drive circuit as set forth in claim 5, wherein the interconnect of said reference current is arranged between power supply interconnects for shield.

16. A current output type drive circuit as set forth in claim 5, wherein the interconnect of said reference current, when a multilayer interconnect including a power supply layer for shield, is arranged at a top layer of said power supply layer for shield.

17. A current output type drive circuit as set forth in claim 5, further comprising means for suppressing great fluctuations of the potential of said common reference current interconnect when the circuits sampling and holding the reference currents of the drivers are all off.

18. A display device for outputting a drive current to a shared area of a display panel shared by being divided into a plurality of areas, comprising a plurality of drivers arranged corresponding to each the shared area of the display panel, each driver comprising an output means for outputting a supplied reference current to a corresponding shared area of the driven object and a reference current source circuit for sampling and holding the reference current input from a reference current input terminal, then supplying the same to the output means, wherein each driver is a driver outputting currents of a plurality of channels in accordance with input data, further comprises a register array for holding said input data, and further comprises means for increasing the reference current sampled and held by the reference current source circuit to a plurality of reference currents by further copying or distributing them by time division, and said output means comprises a plurality of conversion circuits for receiving said plurality of reference currents and outputting currents in accordance with the data held by the register array and a current output circuit comprising a first group of current sampling circuits and a second group of current sampling circuits operating alternately in a current write mode and current read mode in accordance with the output currents of the conversion circuits.

19. A display device for outputting a drive current to a shared area of a display panel shared by being divided into a plurality of areas, comprising a plurality of drivers arranged corresponding to each the shared area of the display panel, each driver comprising an output means for outputting a supplied reference current to a corresponding shared area of the driven object and a reference current source circuit for sampling and holding a reference current input from a reference current input terminal, then supplying the same to the output means, the reference current input terminal being connected to a reference current input terminal of another driver by a common current interconnect, and the reference current being distributed to the reference current source circuits of the drivers by time division, wherein each driver is a driver outputting currents of a plurality of channels in accordance with input data, further comprises a register array for holding said input data, and further comprises means for increasing the reference current sampled and held by the reference current source circuit to a plurality of reference currents by further copying or distributing them by time division, and said output means comprises a plurality of conversion circuits for receiving said plurality of reference currents and outputting currents in accordance with the data held by the register array and a current output circuit comprising a first group of current sampling circuits and a second group of current sampling circuits operating alternately in a current write mode and current read mode in accordance with the output currents of the conversion circuits.

20. A display device as set forth in claim 19, wherein each driver fetches said reference current from said reference current input terminal to said reference current source circuit when receiving a signal indicating start of distribution of reference current and outputs the signal indicating start of distribution of reference current to the driver circuit of the next stage.

21. A display device as set forth in claim 19, wherein each driver comprises a data memory, writes input data into said data memory when receiving a first signal indicating start of writing of data and outputs said first signal indicating start of writing of data to the driver of the next stage and fetches said reference current from said reference current input terminal to said reference current source circuit in synchronization with said first signal when receiving a second signal indicating start of distribution of reference current and outputs said second signal indicating start of distribution of reference current to the driver circuit of the next stage.

22. A display device as set forth in claim 19, wherein the interconnect of said reference current is arranged between power supply interconnects for shield.

23. A display device as set forth in claim 19, wherein the interconnect of said reference current, when a multilayer interconnect including a power supply layer for shield, is arranged at a top layer of said power supply layer for shield.

24. A display device as set forth in claim 19, further comprising means for suppressing great fluctuations of the potential of said common reference current interconnect when the circuits sampling and holding the reference currents of the drivers are all off.

* * * * *

UNITED STATES PATENT AND TRADEMARK OFFICE

CERTIFICATE OF CORRECTION

PATENT NO. : 7,652,650 B2
APPLICATION NO. : 10/525203
DATED : January 26, 2010
INVENTOR(S) : Takagi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1189 days.

Signed and Sealed this

Twenty-eighth Day of December, 2010

David J. Kappos

David J. Kappos
*Director of the United States Patent and Trademark Office*